US007023126B2

(12) United States Patent
Smith

(10) Patent No.: US 7,023,126 B2
(45) Date of Patent: Apr. 4, 2006

(54) SURFACE STRUCTURES FOR HALO REDUCTION IN ELECTRON BOMBARDED DEVICES

(75) Inventor: Arlynn Walter Smith, Blue Ridge, VA (US)

(73) Assignee: ITT Manufacturing Enterprises Inc., Wilmington, DE (US)

( * ) Notice: Subject to any disclaimer, the term of this patent is extended or adjusted under 35 U.S.C. 154(b) by 219 days.

(21) Appl. No.: 10/727,705

(22) Filed: Dec. 3, 2003

(65) Prior Publication Data

US 2005/0122021 A1 Jun. 9, 2005

(51) Int. Cl.
*H01J 43/00* (2006.01)

(52) U.S. Cl. ..... 313/105 CM; 313/540

(58) Field of Classification Search ..... 313/523, 313/540–544, 103 CM, 104, 105 CM
See application file for complete search history.

(56) References Cited

U.S. PATENT DOCUMENTS 6,005,239 A 12/1999 Suzuki et al.
6,433,487 B1 * 8/2002 Yamazaki ..... 315/169.3

OTHER PUBLICATIONS

A.W. Smith et al., "A new texturing geometry for producing high efficiency solar cells with no antirflection coatings", Solar Energy Materials and Solar Cells, vol. 29, pps. 51–65, 1993.

J. Freeman et al., "Hybrid photodiode crosstalk due to backscattered electrons", Nucl. Instr. and Meth. Phys. Res. A (NIMA), vol. 474, pps. 143–150, 2001.

G. Williams Jr. et al., "Electron bombarded back illuminated CCD sensor for low light level imaging applications", Proceedings of SPIE, vol. 2415, pps. 211–235, 1995.

F. Andoh et al., "Development of a novel image intensifier of an amplified metal–oxide–semiconductor imager overlaid with electron bombardment amorphous silicon", IEEE Trans. Elec. Dev., vol. 45, pps. 778–784, 1998.

T.A. Yost et al., "Large area, high speed phototube with a GaAsP photocathode and GaAs metal–semiconductor–metal anode", IEEE, pps. 90–92, 1998.

W. van Roosbroeck, "Theory of the yield and Fano factor of electron–hole pairs generated in semiconductors by high–energy particles", Phys, Rev., vol. 139, pps. A1703–1716, 1965.

E.J. Bender, "Present image intensifier tube structures", in Electro–Optical Imaging: System Performance and Modelling, L.M. Biberman, SPIE Press, Bellingham, Washington, 2000.

A.W. Smith et al., "Ray tracing analysis of the inverted pyramid texturing geometry for high efficiency silicon solar cells,", Solar Energy Materials and Solar Cells, vol. 29, pps. 37–49, 1993.

* cited by examiner

*Primary Examiner*—Vip Patel
(74) *Attorney, Agent, or Firm*—RatnerPrestia

(57) ABSTRACT

An electron sensing device includes a cathode for providing a source of electrons, and an anode disposed opposite to the cathode for receiving electrons emitted from the cathode. The anode includes a textured surface for reducing halo in the output signal of the electron sensing device. The textured surface may include either pits or inverted pyramids.

20 Claims, 24 Drawing Sheets

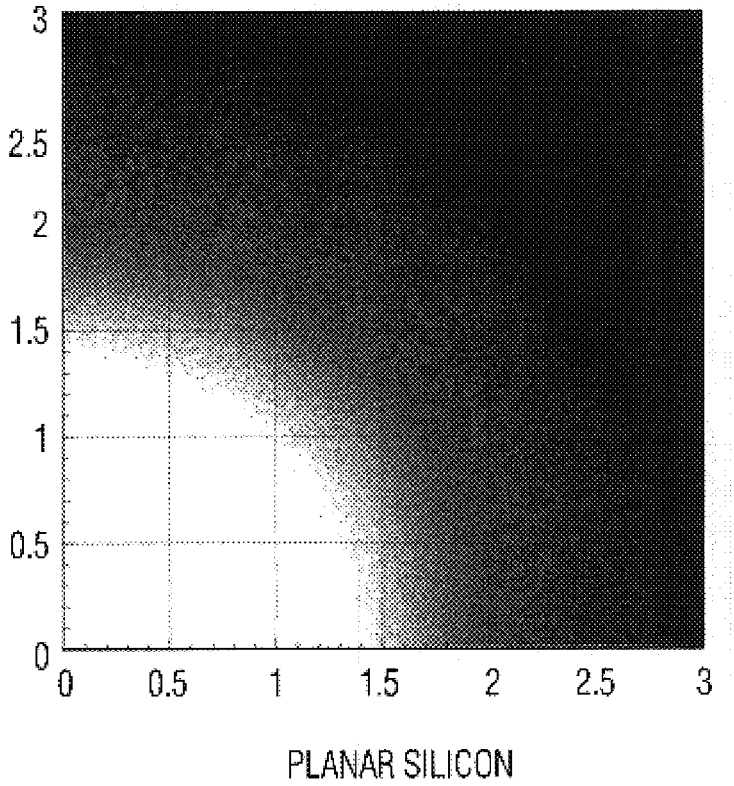
FIG. 8A1
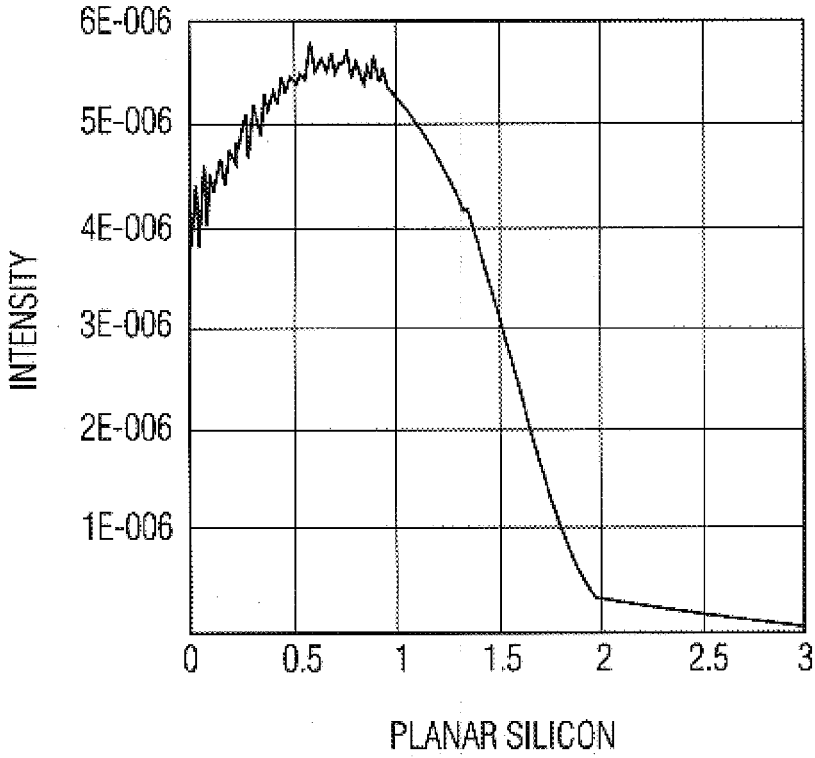
FIG. 8A2

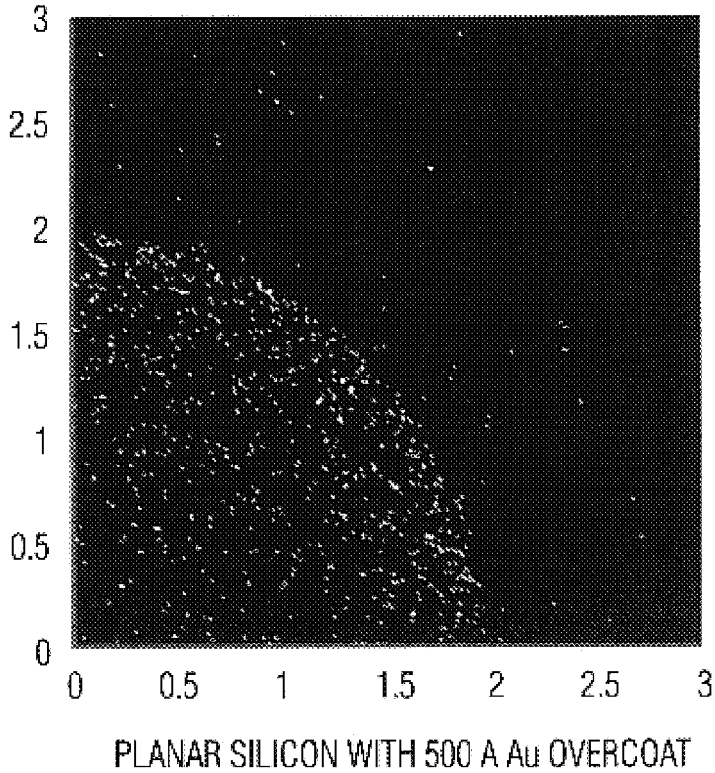
FIG. 8B1
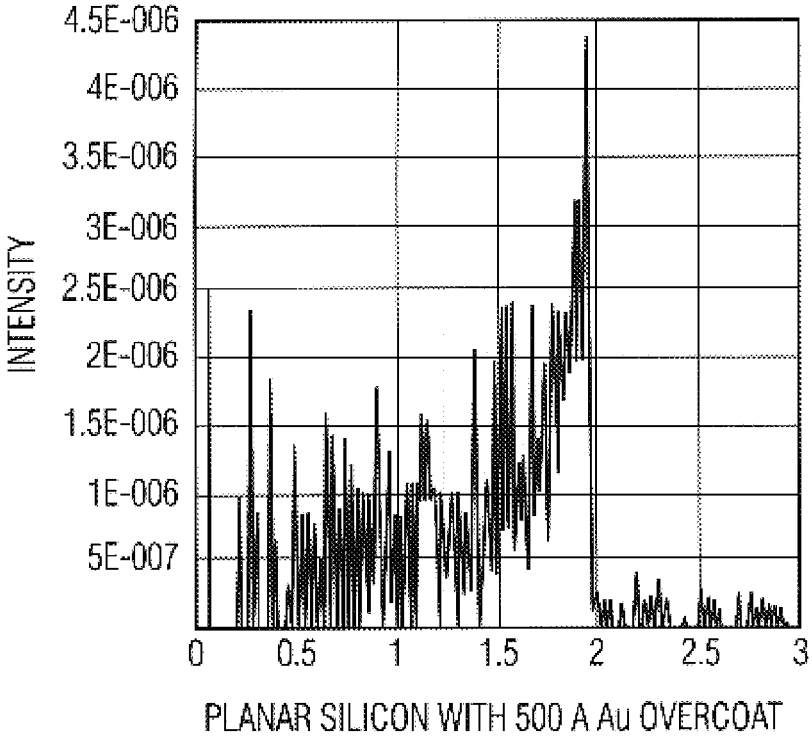
FIG. 8B2

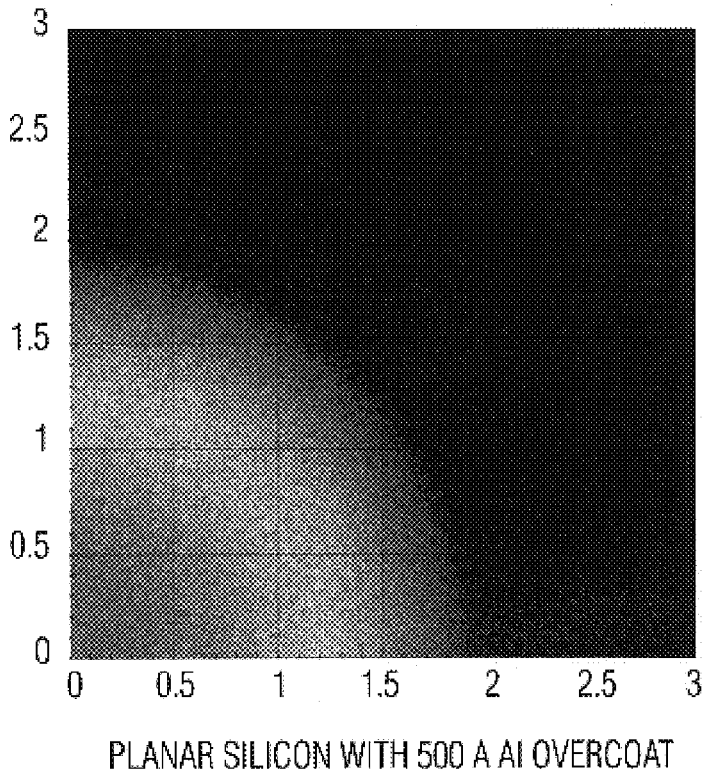
FIG. 8C1
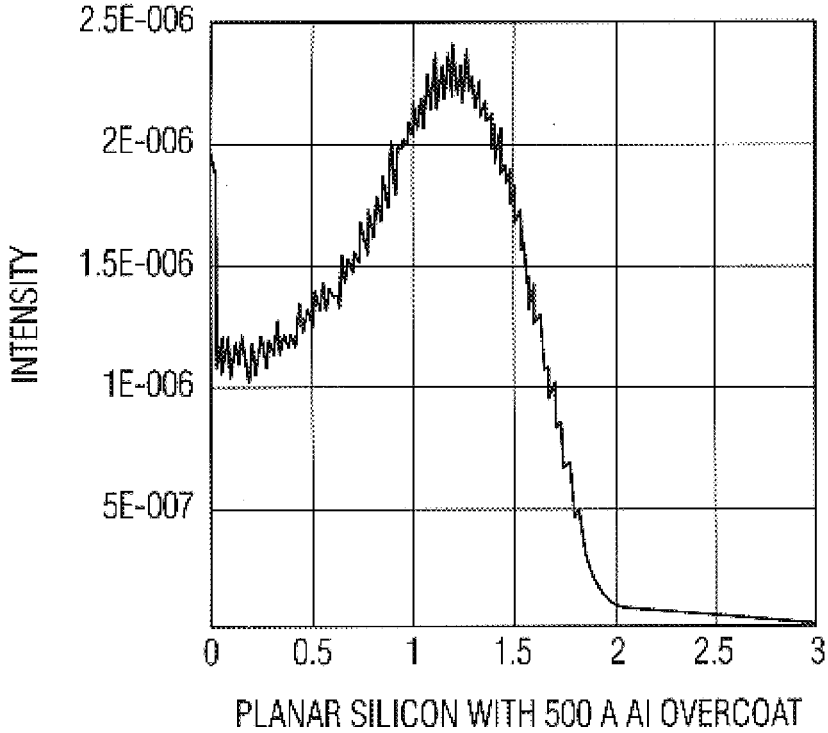
FIG. 8C2

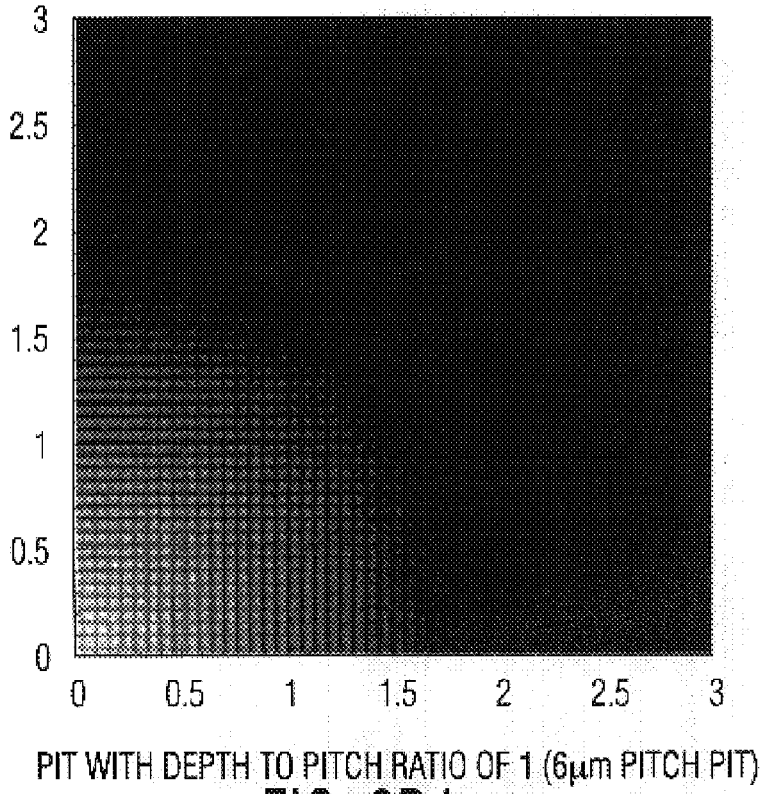
FIG. 8D1
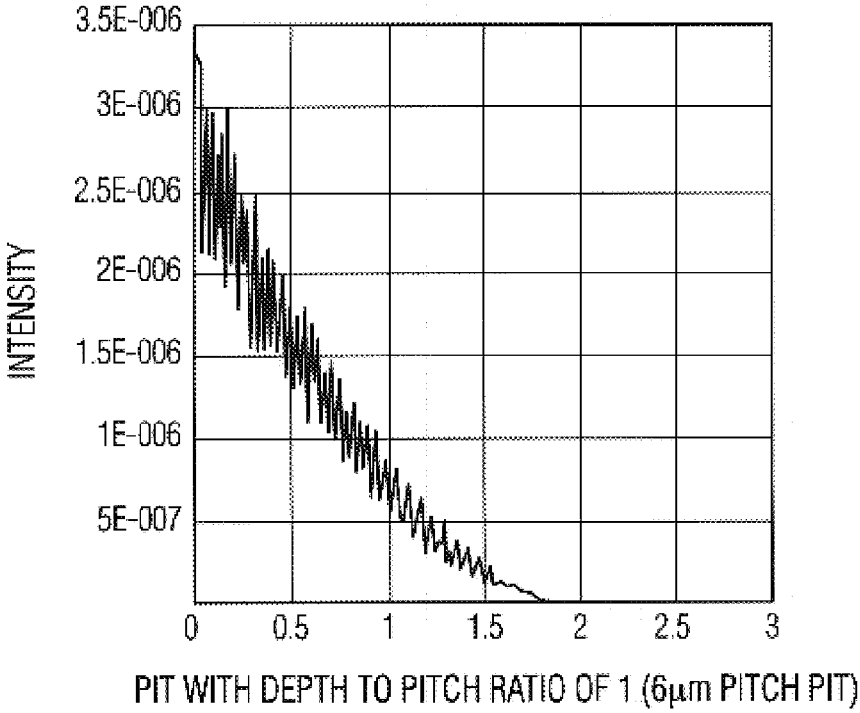
FIG. 8D2

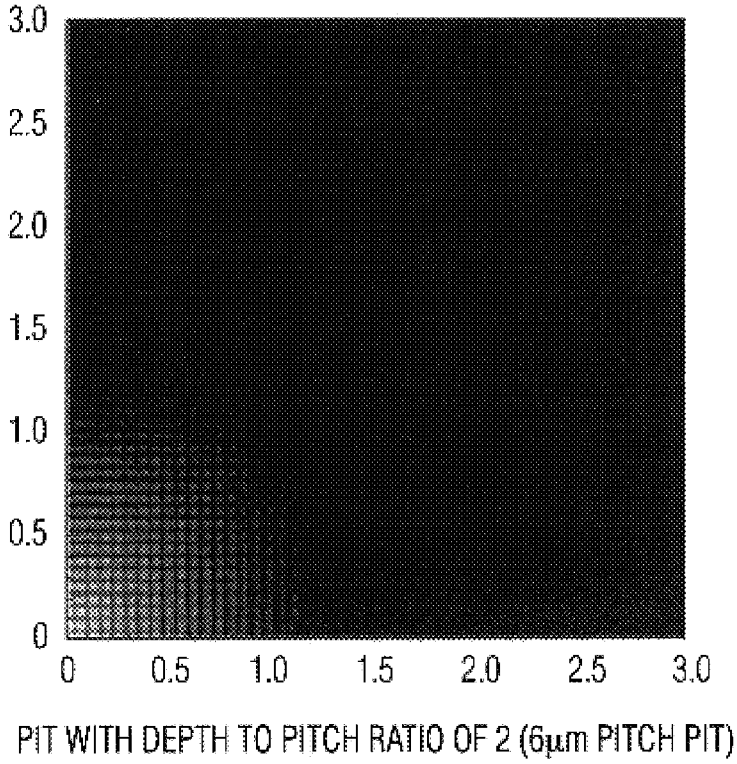
FIG. 8E1
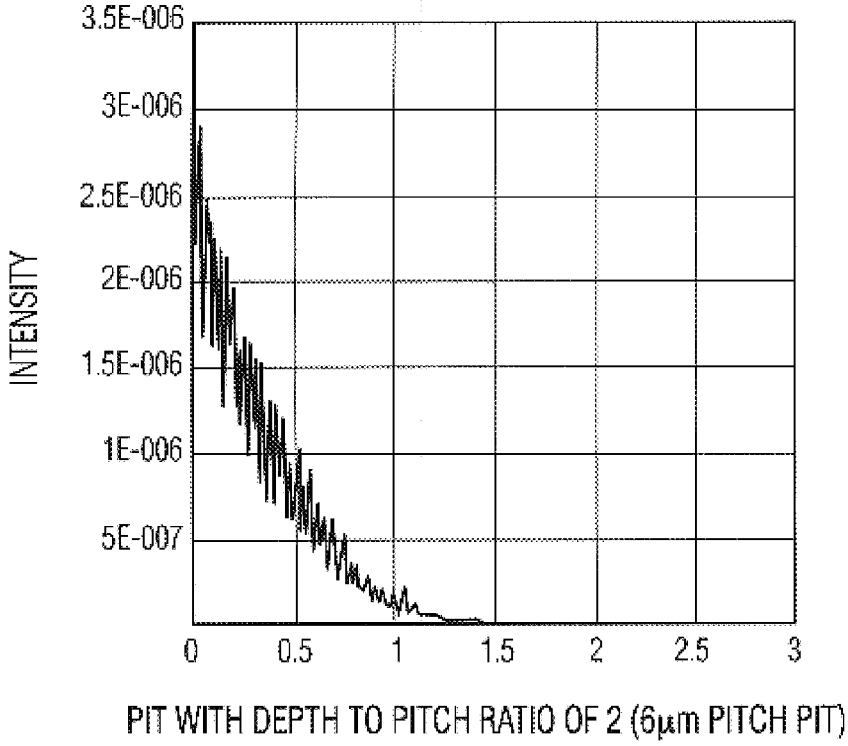
FIG. 8E2

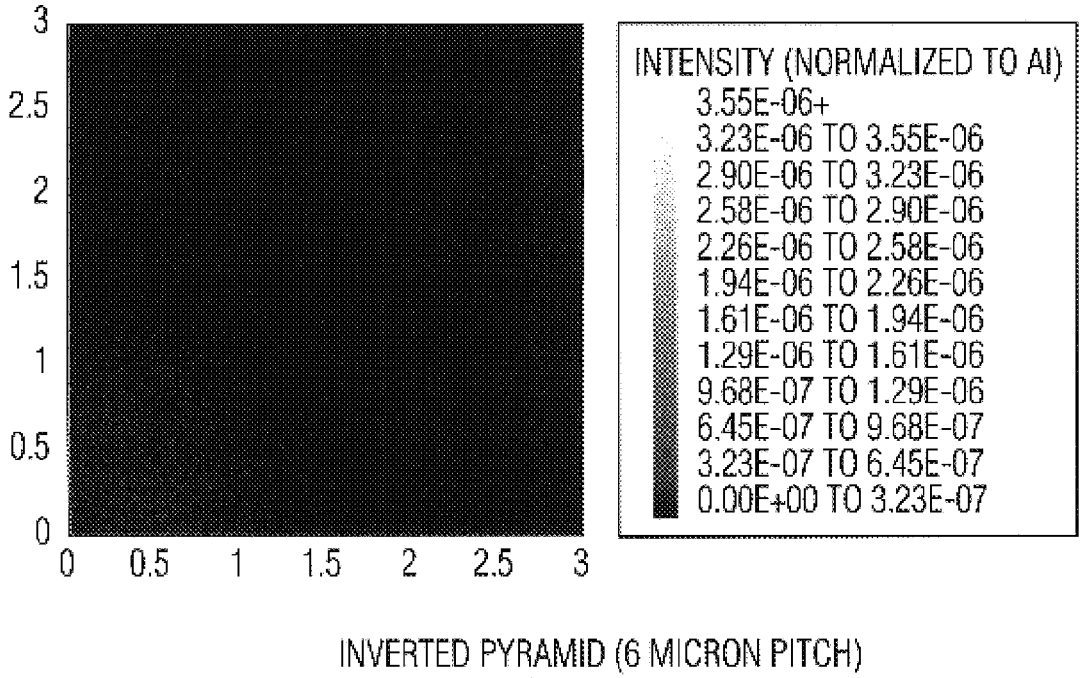
FIG. 8F1
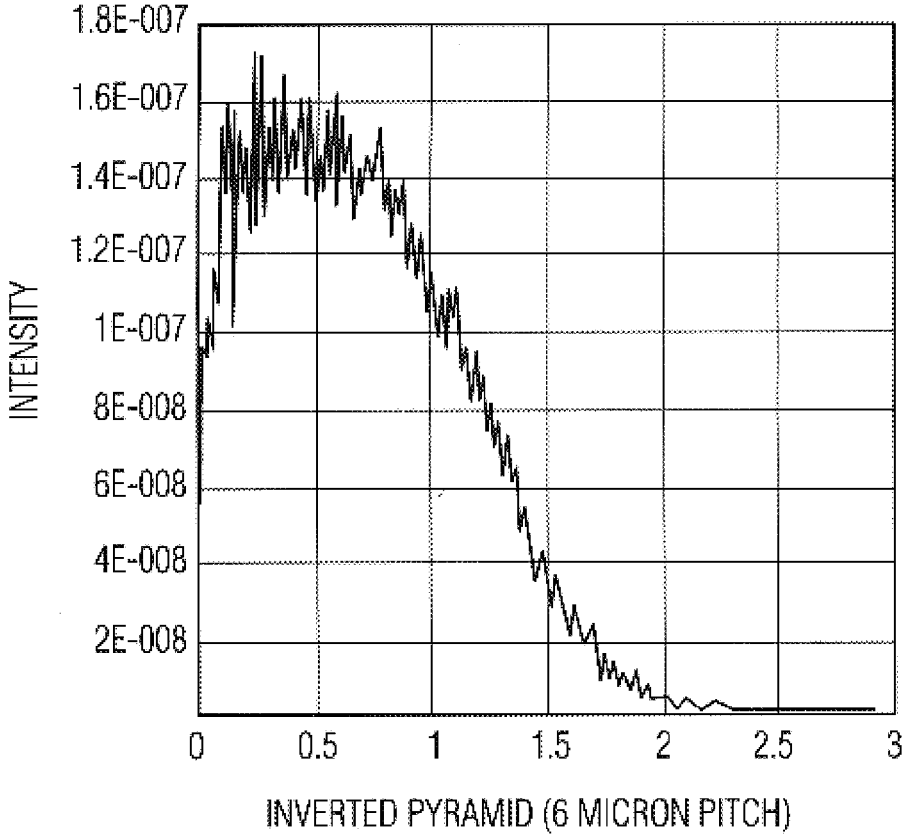
FIG. 8F2

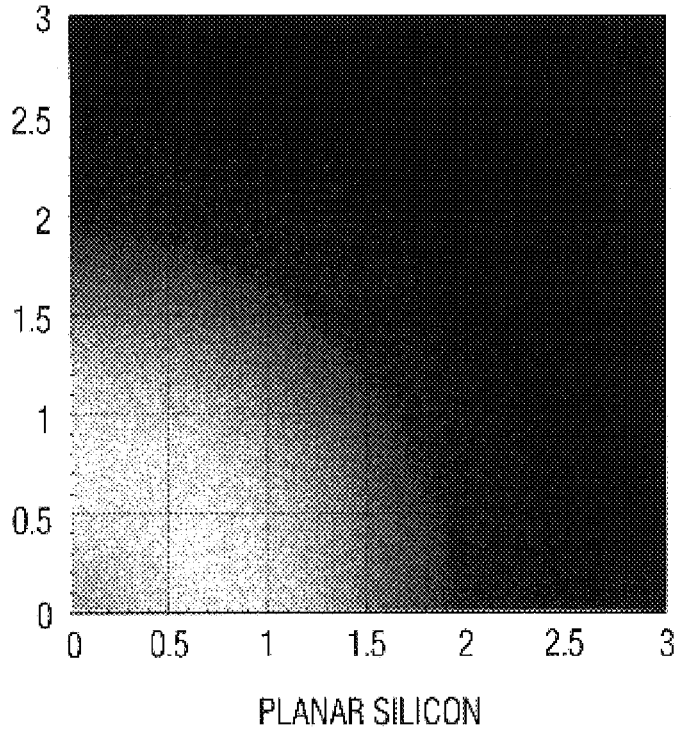
FIG. 9A1
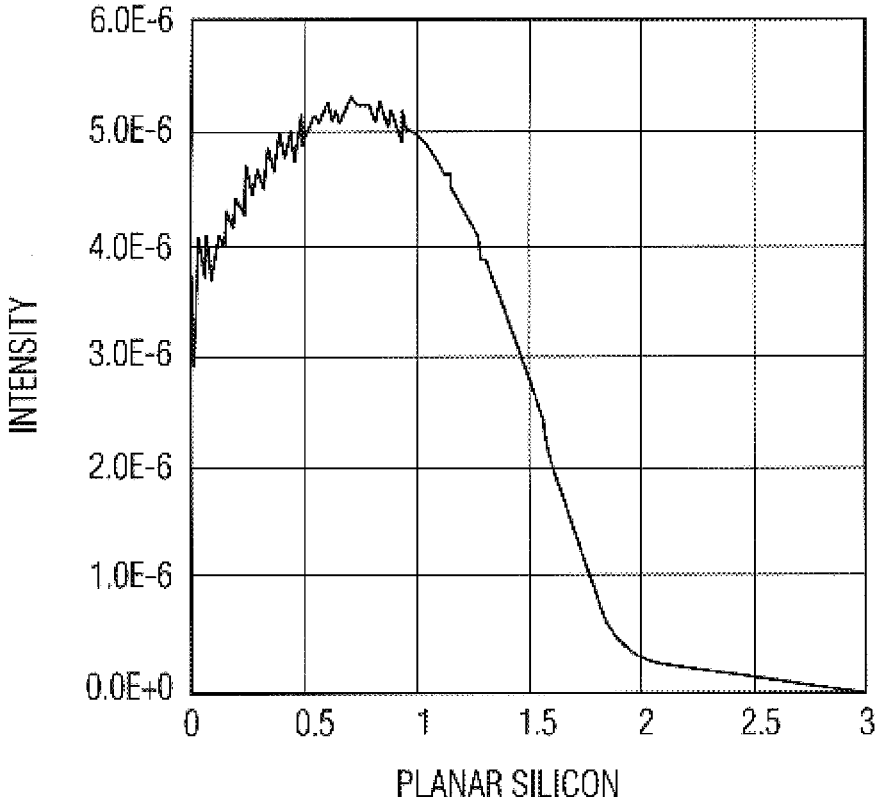
FIG. 9A2

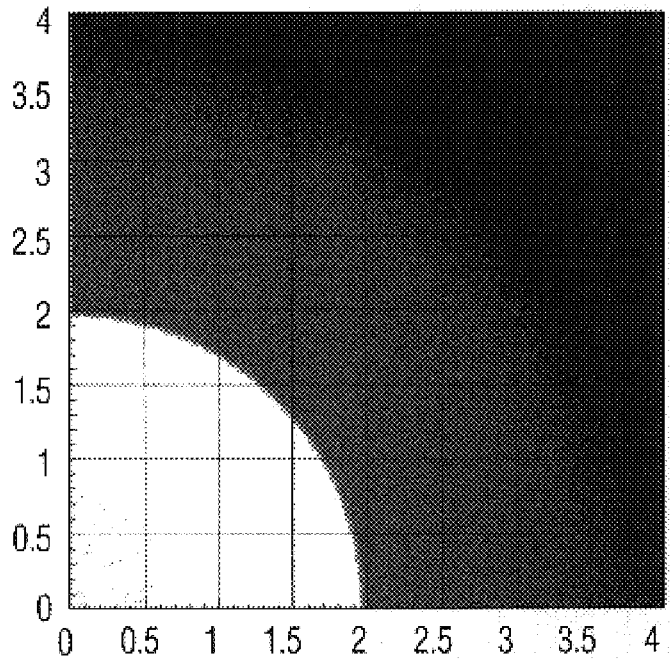
PLANAR SILICON WITH 500 A Au
FIG. 9B1
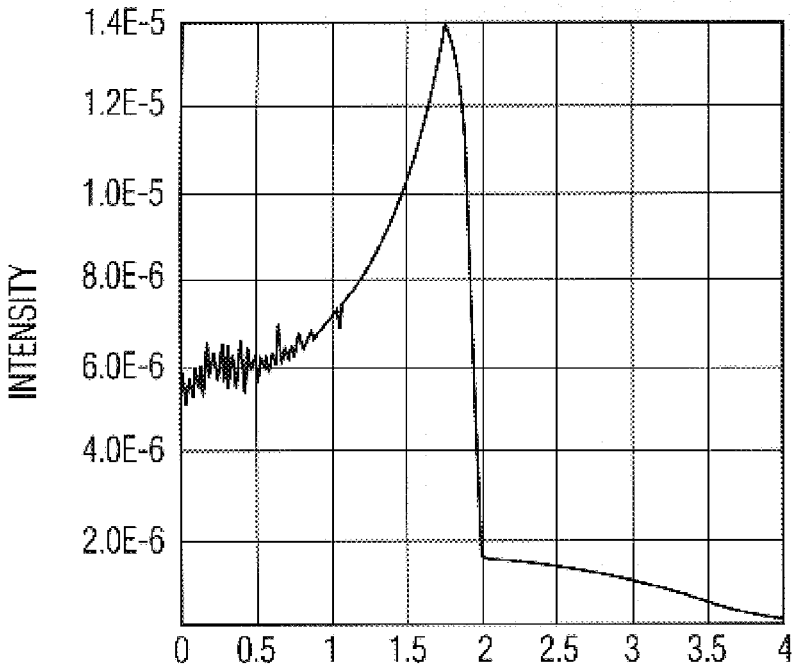
PLANAR SILICON WITH 500 A Au
FIG. 9B2

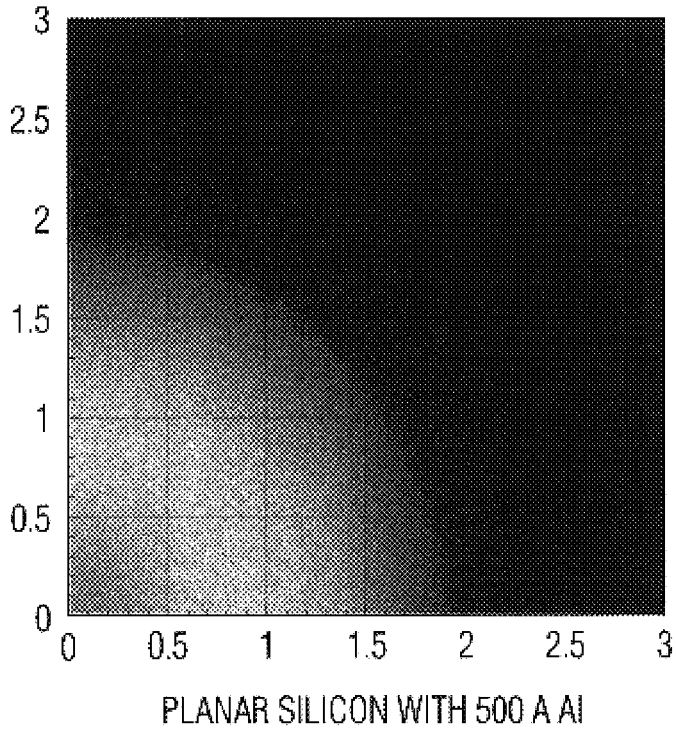
FIG. 9C1
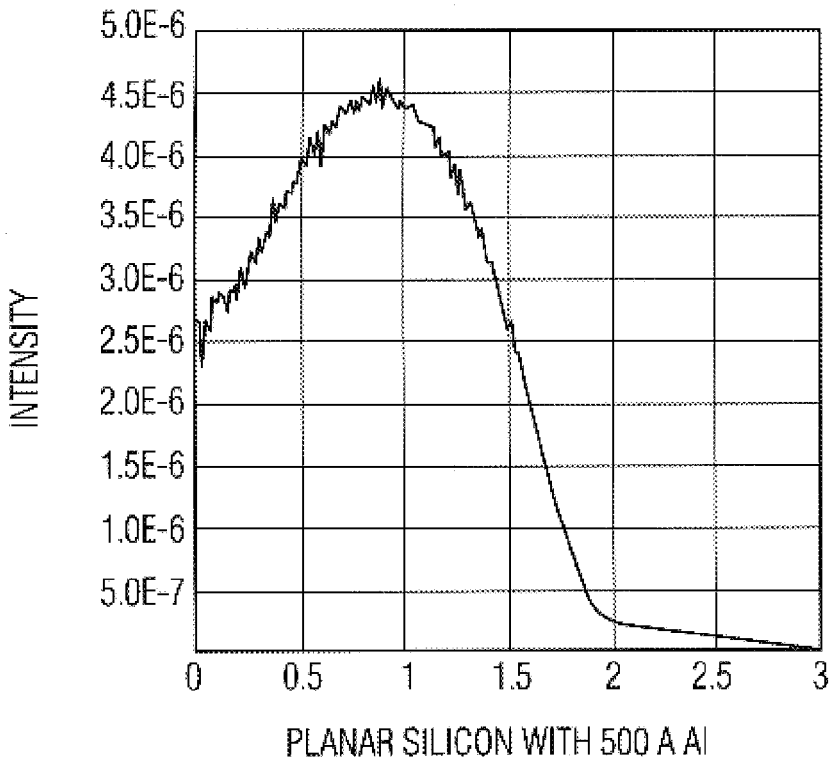
FIG. 9C2

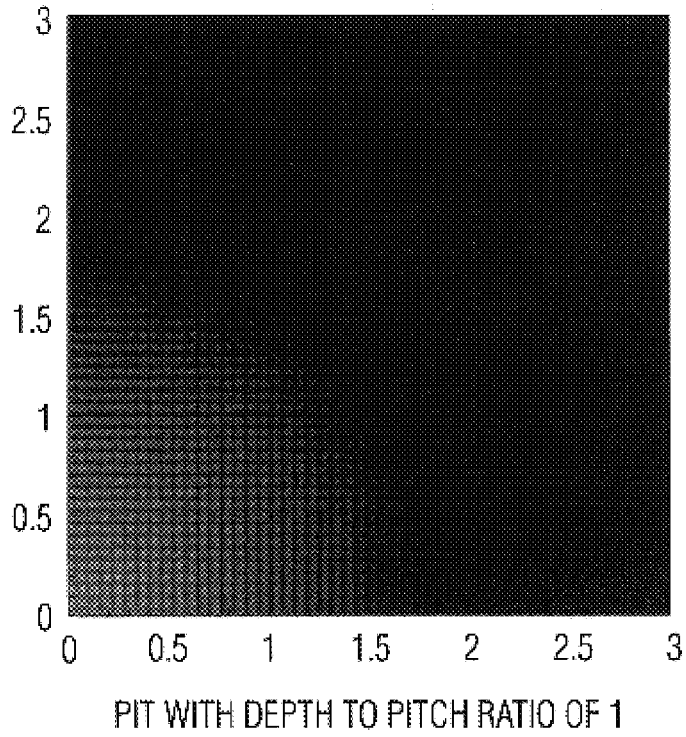
FIG. 9D1
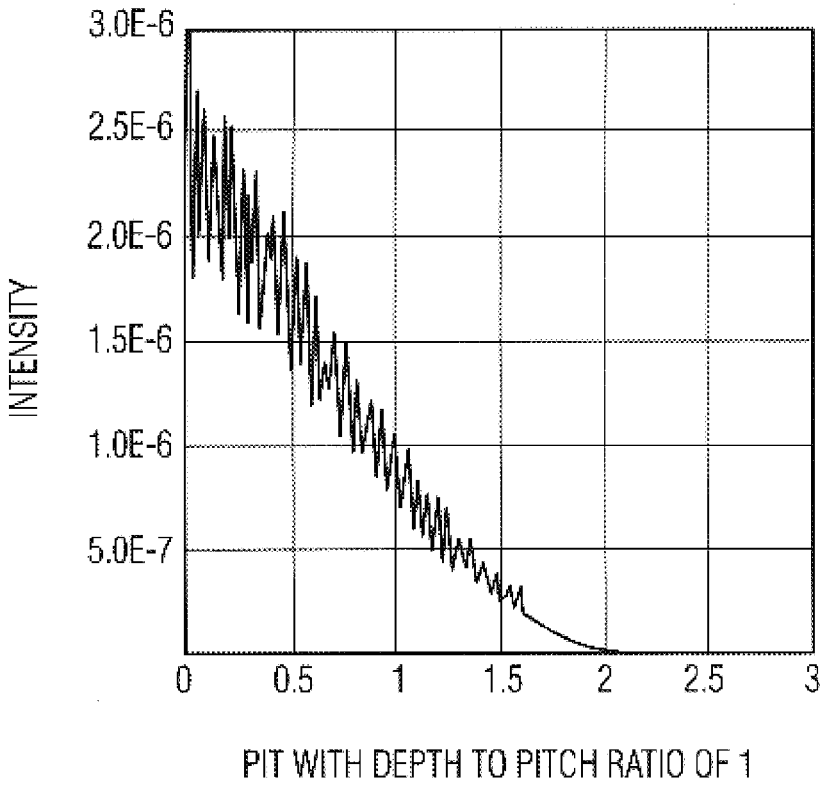
FIG. 9D2

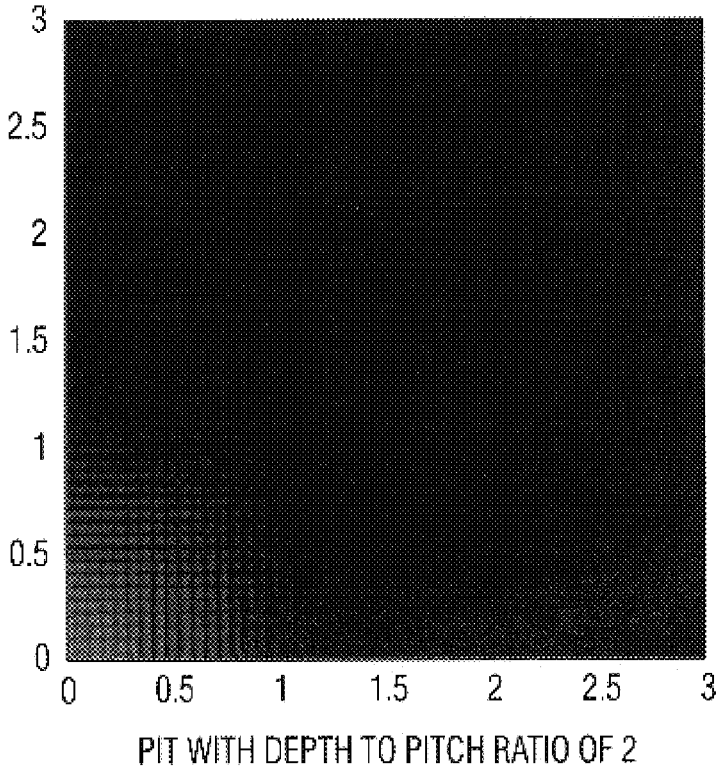
FIG. 9E1
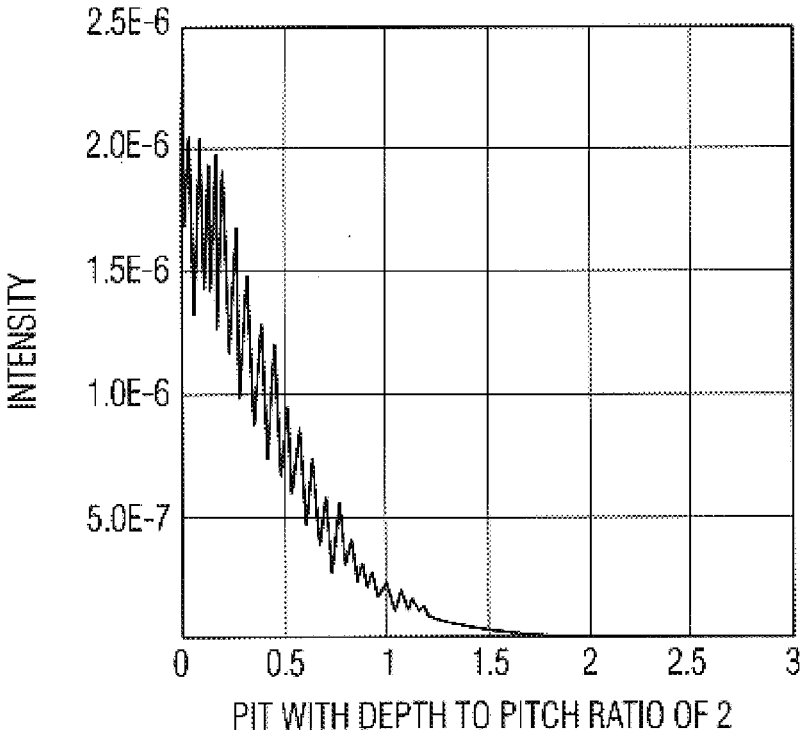
FIG. 9E2

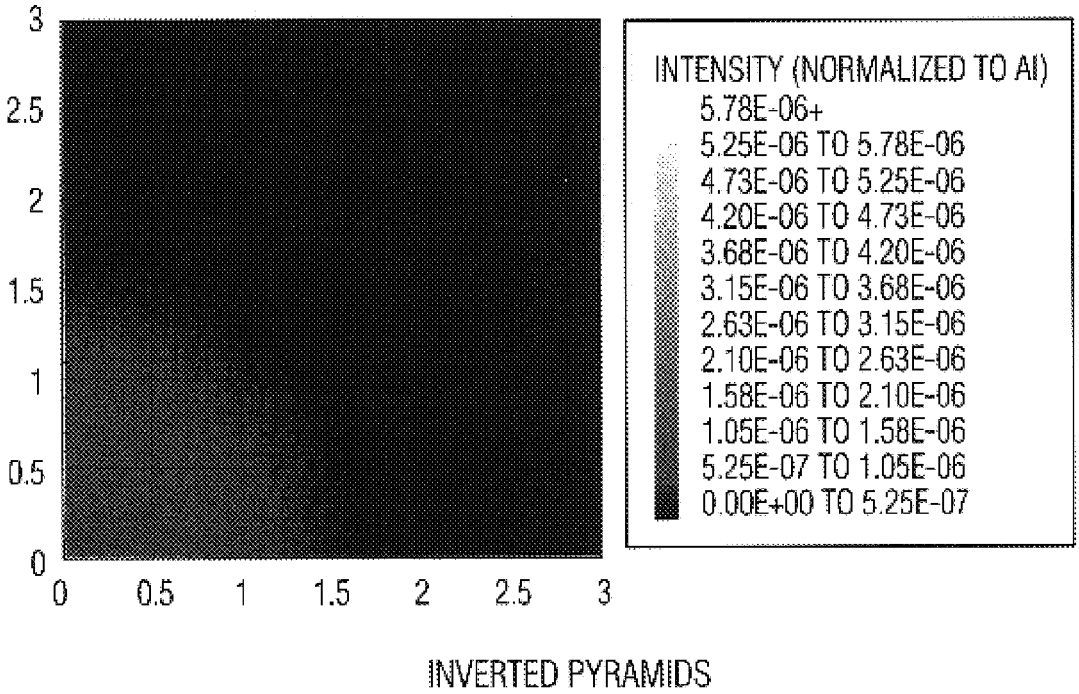
FIG. 9F1
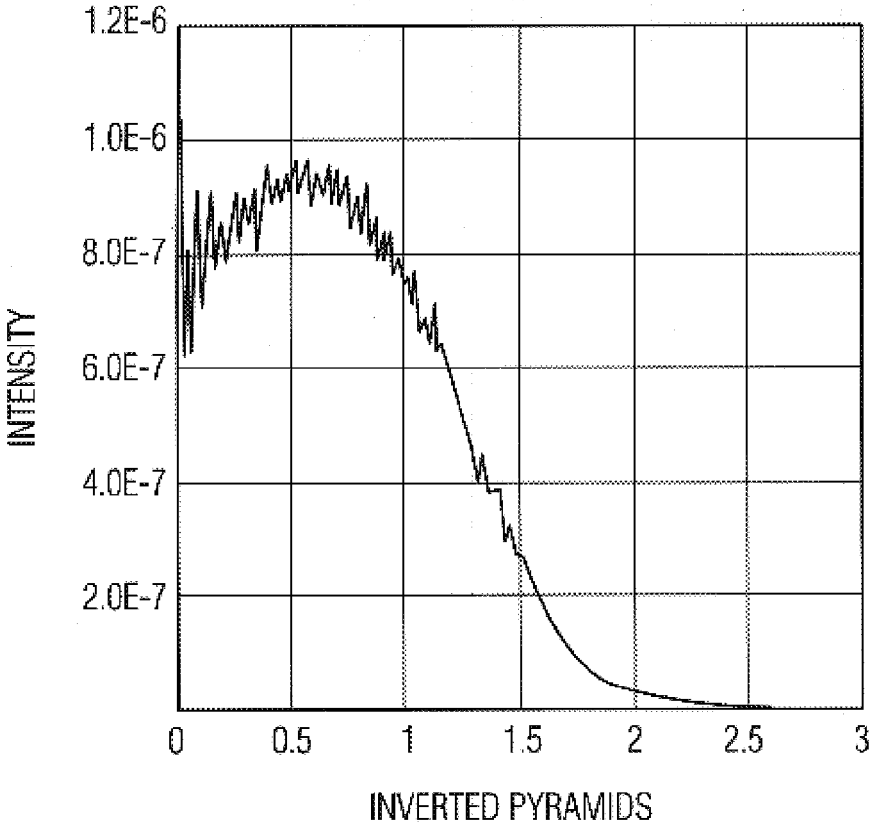
FIG. 9F2

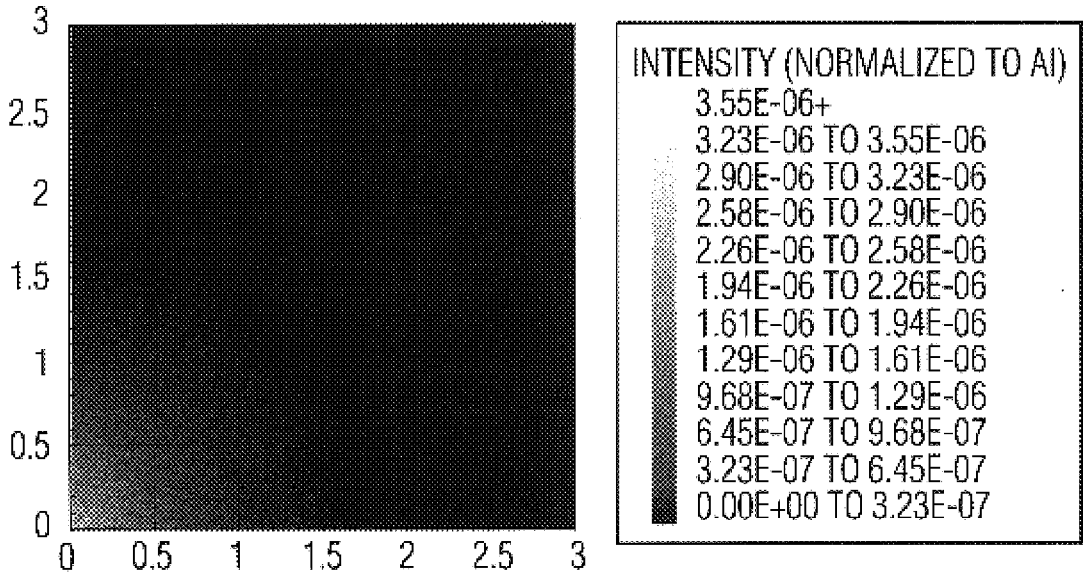
1μm PITCH PITS, DEPTH TO PITCH RATIO OF 1
FIG. 13A1
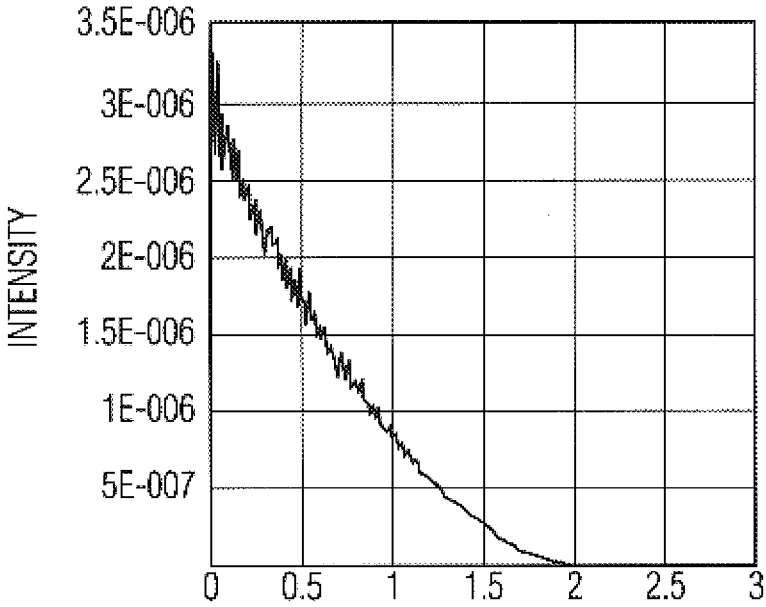
1μm PITCH PITS, DEPTH TO PITCH RATIO OF 1
FIG. 13A2

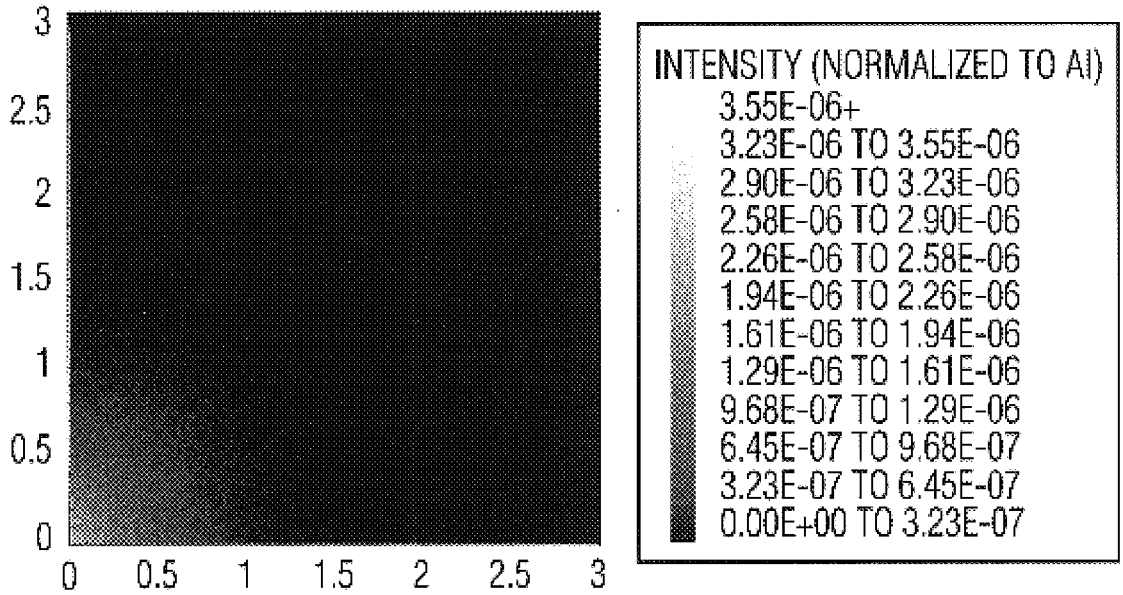
1μm PITCH PITS, DEPTH TO PITCH RATIO OF 2
FIG. 13B1
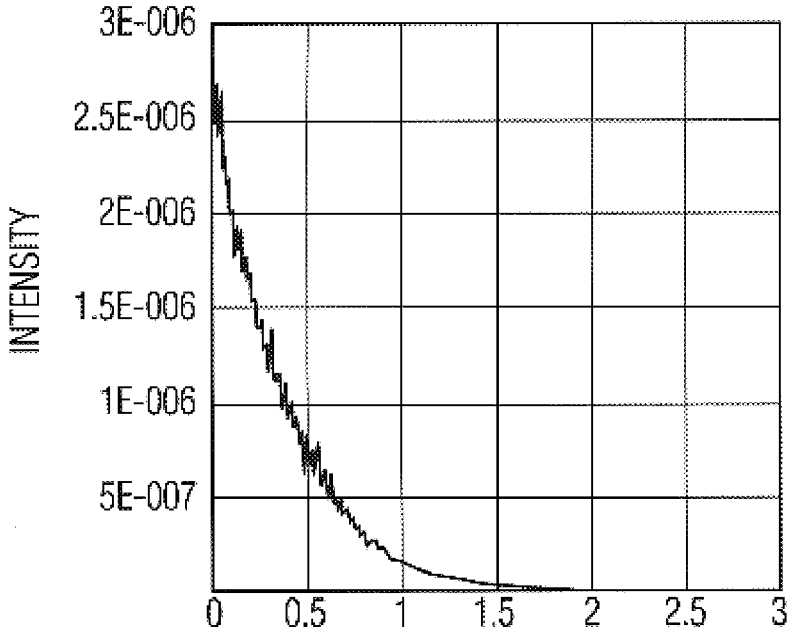
1μm PITCH PITS, DEPTH TO PITCH RATIO OF 2
FIG. 13B2

SURFACE STRUCTURES FOR HALO REDUCTION IN ELECTRON BOMBARDED DEVICES

TECHNICAL FIELD

The present invention relates, in general, to electron sensing devices and, more specifically, to surface structures for reducing halos that are produced by electron sensing devices when amplifying received signals.

BACKGROUND OF THE INVENTION

Electron sensing devices, or electron bombarded devices rely on high energy electrons to generate gain by a cascade or knock-on process. One consequence of these high energy electrons is the probability that they may be backscattered upon impact with the electron collection surface of the device. The backscattered electrons produce a loss in signal and spatial resolution.

There is a class of devices that use high energy electrons bombarding a surface to produce gain and amplify a small signal. Examples of such devices are hybrid photodiodes (HPDs), electron bombarded active pixel sensors (EBAPSs), electron bombarded CCDs (EBCCDs), electron bombarded metal-semiconductor-metal (MSM) vacuum phototubes (MSMVPTs), avalanche photo diodes (APDs) and resistive anodes. For the cases of EBAPS and EBCCD, spatial resolution is paramount to maintain image quality. Signal strength is also a factor for low light level imaging. Although spatial resolution is less important for HPDs and MSMVPTs, signal integrity is an overriding factor, as the devices require single photon detection and high speed. Even so, spatial resolution is important for segmented photodiodes.

A consequence of using high energy electrons is that a fraction of the primary electrons are backscattered. If the backscattered electron does not land on the detector, then signal is lost, but there is no spatial degradation. If the backscattered electron, however, lands again on the detector, then the signal level is maintained, but it is spatially displaced from the original impact point.

Typically, these bombarded devices have planar semiconductor surfaces, and the high energy electrons impact these planar surfaces. A portion of the high energy electrons are backscattered. The backscattered electrons may be considered as being reflected, much like light is reflected from a surface of a solar cell. In a solar cell, anti-reflection coatings (ARCs) are used to reduce the reflection of the light. Electron bombarded device, however, cannot use ARCs, because ARCs attenuate the power of the incident signal and, therefore, reduce gain of the devices. An alternative to ARCs in solar cell technology is use of textured surfaces. Textured surfaces are used to decrease reflection from surfaces of highly efficient solar cells.

There are three objectives in designing solar cells: (1) reduce the front reflection, (2) increase the path length, and (3) trap weakly absorbed light reflected from the back. In the case of electron bombarded surfaces, however, the last objective is not applicable, due to the very short path length of the high energy electrons. Although textured surfaces have successfully been used in the field of solar cells to improve light absorption, textured surfaces have not been used in the field of electron bombarded devices to reduce backscattering of electrons and reduce halos in the output images.

In U.S. Pat. No. 6,005,239, issued on Dec. 21, 1999, Suzuki et al. disclose an image intensifier including a transparent entrance faceplate, and an optical fiber block. The fiber block is made of many optical fibers bundled together, and is disposed opposite to the entrance faceplate. A vacuum atmosphere is formed between the entrance faceplate and the optical fiber block. The optical fiber block is provided with pits, in which each pit includes an end face of a core portion of an optical fiber that is recessed from an end face of a cladding portion of the optical fiber. The cladding portion projects from the surface of the recessed core portion, thereby forming a pit. Accordingly, Suzuki et al. teach formation of pits in an optical fiber block, which are made of many optical fibers bundled together for reducing the halo phenomenon of output light.

A need exists for reducing the halo phenomenon for electron bombarded devices, such as HPDs, EBAPSs, EBCCDs, MSMVPTs, APDs and resistive anodes. A need also exists for reducing electron backscattering in these devices and, thereby increase gain. The present invention addresses these needs.

SUMMARY OF THE INVENTION

To meet this and other needs, and in view of its purposes, the present invention provides an electron sensing device including a cathode for providing a source of electrons, and an anode disposed opposite to the cathode for receiving electrons emitted from the cathode. The anode includes a textured surface for reducing halo in the output signal of the electron sensing device.

In one embodiment of the invention, the textured surface includes a plurality of pits formed in the anode. A pit of the plurality of pits is shaped as a well having a top opening formed by longitudinal walls in the anode, and a bottom surface of the well is disposed longitudinally further from the cathode than the top opening. The plurality of pits are transversely spaced from each other by a pitch value varying from 1.0 micron to 30.0 microns, and include longitudinal depths varying from a depth to pitch ratio of 0.5 to a depth to pitch ratio of 2.0. The plurality of pits are spaced from each other to form an open area ratio (OAR) varying from 70% to 90% in the anode.

The electron sensing device including the pits may be a hybrid photodiode (HPD), an electron bombarded active pixel sensor (EBAPS), an electron bombarded charge coupled diode (EBCCD), an electron bombarded metal-semiconductor-metal vacuum phototube (MSMVPT), an avalanche photo diode (APD), or a resistive anode.

In another embodiment of the invention, an electron sensing device includes a cathode for providing a source of electrons, and an anode disposed opposite to the cathode for receiving electrons emitted from the cathode. The anode includes a top surface, and the top surface includes a plurality of openings, each defined by a base of an inverted pyramid, for reducing halo in the output signal of the electron sensing device. The base of the inverted pyramid is substantially a square at the top surface of the anode, and walls formed in the anode are extended from the base to form an apex of the inverted pyramid, the apex disposed longitudinally further from the cathode than the base of the inverted pyramid. The base of the inverted pyramid is a 6 micron square, and the apex of the inverted pyramid is longitudinally disposed 4.091 microns from the base.

The electron sensing device including the inverted pyramid may be a hybrid photodiode (HPD), an electron bombarded active pixel sensor (EBAPS), an electron bombarded charge coupled diode (EBCCD), an electron bombarded metal-semiconductor-metal vacuum phototube (MSMVPT), an avalanche photo diode, or a resistive anode.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures:

FIGS. 8*a*–8*f* are photographs showing images on a display of results obtained in a simulation using the textured surfaces shown in FIGS. 3*a*–3*c*, in accordance with an embodiment of the present invention;

FIGS. 9*a*–9*f* are photographs showing images on a display of additional results obtained in a simulation using the textured surfaces shown in FIGS. 3*a*–3*c*, in accordance with an embodiment of the present invention;

FIGS. 13*a*–13*b* are photographs showing images on a display showing results obtained in a simulation using the textured surface shown in FIG. 3*b*, in accordance with an embodiment of the present invention.

DETAILED DESCRIPTION OF THE INVENTION

As will be explained, the present invention reduces backscattering of electrons, reduces the halo phenomenon and increases gain of an electron bombarded device, by providing a textured surface to the electron collection surface of the device.

Figure 1:
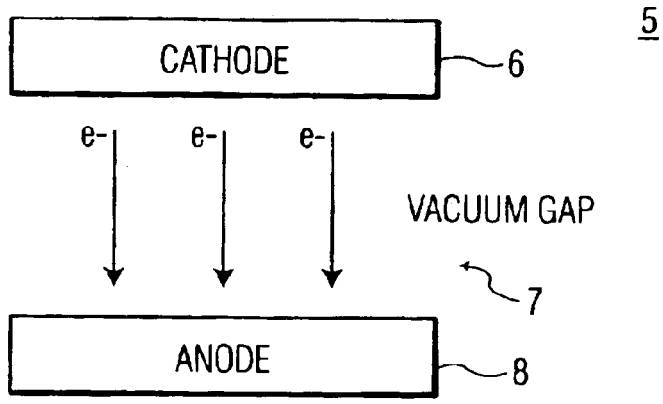
FIG. 1 is a schematic diagram showing an electron sensing device for incorporating an embodiment of the present invention.

Referring to FIG. 1, there is shown an electron bombarded device, generally designated as 5. The device includes cathode 6 and anode 8 which are spatially separated by vacuum gap 7. The anode serves as the electron collection point.

It will be appreciated that electrons are emitted from cathode 6 into vacuum gap 7 by either a negative electron affinity surface (NEA), positive electron affinity surface (PEA), thermionic emission, or field emission. An electric field (not shown) between the cathode and anode accelerates the electrons towards anode 8. Extra electrodes (not shown) with various potentials may also be placed between the cathode and anode to focus the electrons. These electrodes do not change the overall landing potential of the electrons. On impacting the surface of the anode, a primary electron interacts with the material of the anode through scattering events, which are discussed below.

As the primary electron loses energy, some secondary particles are produced, such as x-rays and electron hole pairs resulting from impact ionization. The energy the primary electron loses during impact ionization is approximately equal to three times the bandgap of the material forming the anode. The direction of the electron also changes, as the electron is scattered, leading to a possibility that the electron may exit the material, thus leading to a backscatter event. The probability of backscatter is related to the material properties of the anode, impact energy of the electron and angle of incidence of the electron. In addition, the loss in spatial positioning is related to the distance between the electron source (cathode) and the electron drain (anode) being impacted.

The inventor simulated backscattering of electrons from various anode surfaces and discovered that the energy of a backscattered electron may range from about 50 eV up to nearly the primary electron energy. The energy includes both longitudinal and transverse components due to the scattering. As the electron leaves the material of the anode, the trajectory of the electron is affected by the potential between the cathode and the anode, the potential forcing the electron back down towards the anode. The transverse distance the electron travels is dependent on the angle at which the electron leaves the material of the anode, the energy of the electron, the cathode to anode voltage and the spacing between the cathode and anode.

The inventor also discovered that the first impact maximum transverse distance an electron travels, with energy nearly equal to the primary electron, is twice the distance from the cathode to the anode. Multiple impacts are possible extending the range beyond the initial range. The majority of the electrons travel a distance less than this maximum distance. It will be understood that these electrons are called halo electrons in image intensifiers. That is, a halo or circle of light is formed around a bright point source. As used in this specification, halo electrons denote electrons which are backscattered.

Figure 2:
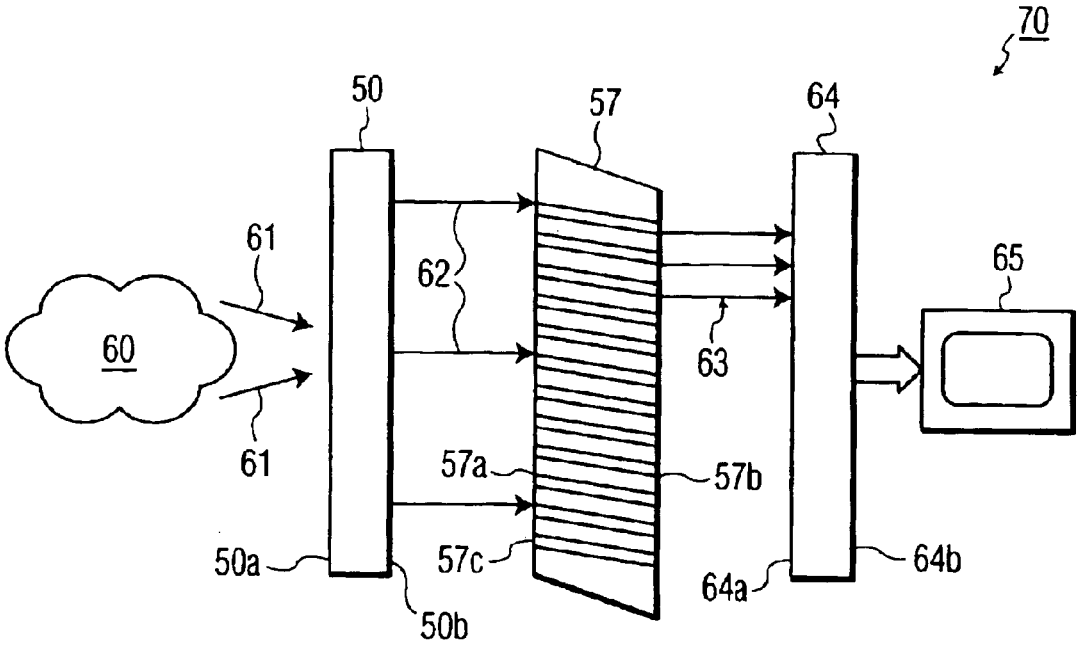
FIG. 2 is a schematic diagram showing the electron sensing device of FIG. 1 with a microchannel plate (MCP) disposed between the cathode and anode for incorporating an embodiment of the present invention.

Referring next to FIG. 2, there is shown schematically an image intensifier tube incorporating the present invention.

As shown, image intensifier 70 includes photocathode 50 having input side 50*a* and output side 50*b*. Image intensifier 70 also includes microchannel plate (MCP) 57 and imager 64. MCP 57 includes input side 57*a* and output side 57*b*, and imager 64 includes input side 64*a* and output side 64*b*. It will be understood that photocathode 50 and imager 64 correspond, respectively, to cathode 6 and anode 8, shown in FIG. 1. MCP 57 is disposed within a vacuum gap formed in a housing (not shown) incorporating photocathode 50 and imager 64. Although MCP 57 is shown disposed between photocathode 50 and imager 64, it will be understood that MCP 57 may be omitted, as shown in FIG. 1.

Imager 64 or anode 8 may be any type of solid-state electron sensor. For example, they may include an imaging CCD device or a CMOS sensor, or a non-imaging sensor such as a MSM, APD, or resistive anode.

In operation, light 61 from image 60 enters image intensifier 70, through input side 50*a* of photocathode 50. Photocathode 50 changes the entering light into electrons 62, which are output from output side 50*b* of photocathode 50. Electrons 62, exiting photocathode 50, enter channels 57*c* through input surface 57*a* of MCP 57. After electrons 62 bombard input surface 57*a* of MCP 57, secondary electrons are generated within the plurality of channels 57*c* of MCP 57. MCP 57 may generate several hundred electrons in each of channels 57*c* for each electron entering through input surface 57*a*. Thus, the number of electrons 63 exiting channels 57*c* is significantly greater than the number of electrons 62 that entered channels 57*c*. The intensified number of electrons 63 exit channels 57*c* through output side 57*b* of MCP 57, and strike electron receiving surface 64*a* of imager 64. The output of imager 64 may be stored in a register, then transferred to a readout register, amplified and displayed on video display 65.

Figure 3A:
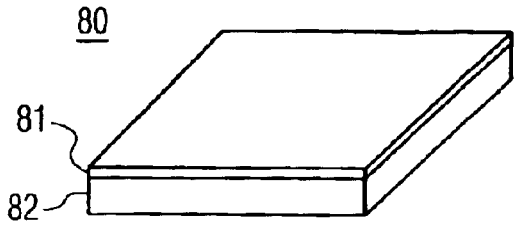
FIGS. 3*a*–3*d* are enlarged views of textured surfaces of the anode structure shown in FIG. 1, in accordance with an embodiment of the present invention.

Referring to FIGS. 3*a*–3*d*, there are shown four embodiments of the present invention, each used as an electron collection plate for imager 64 (FIG. 2) or anode 8 (FIG. 1). Each embodiment includes a different surface geometry. For example, FIG. 3*a* shows electron collection plate 80 including a planar layer of silicon 82 with a top-coated aluminum layer 81 of 500 A° thickness. Top coated layer 81 may also be a gold layer of 500 A° thickness.

Figure 3B:
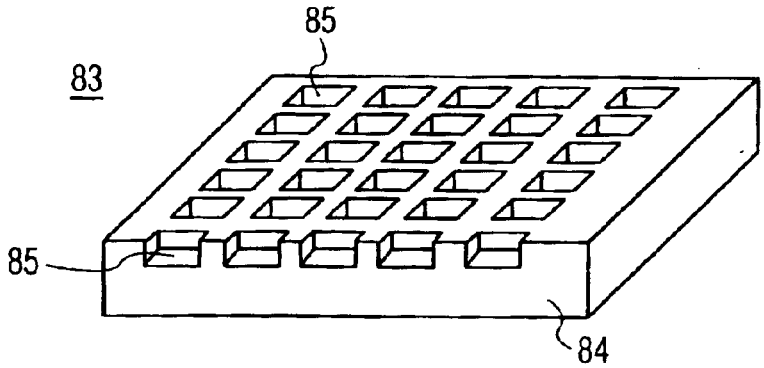
Figure 3C:
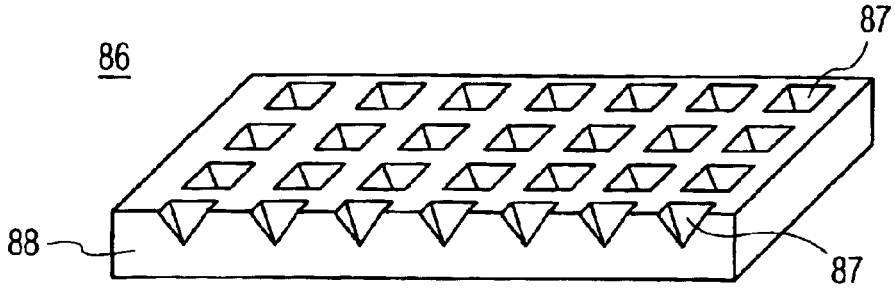

FIG. 3*b* shows electron collection plate 83 including multiple pits (or wells) 85 etched into the top surface of a planar layer of silicon 84. FIG. 3*c* depicts electron collection plate 86 including multiple inverted pyramids 87 etched into the top surface of a planar layer of silicon 88. The dimensions of the pit geometries of FIG. 3*b* and the inverted pyramid geometries of FIG. 3*c* are discusssed below.

Figure 3D:
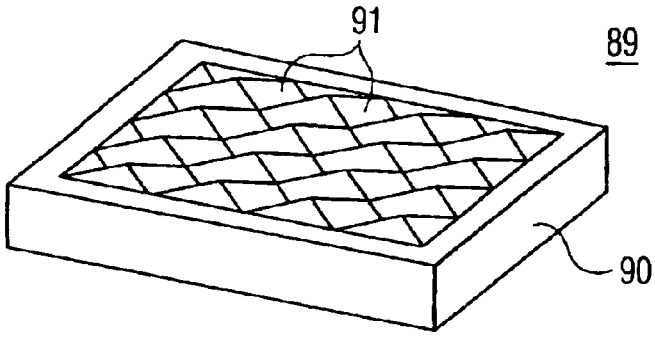

FIG. 3*d* depicts electron collection plate 89 including multiple inverted tetrahedrons 91 etched into the top surface of a planar layer of silicon 90. Inverted tetrahedrons, each have three perpendicular planes, oriented 90° with respect to the base of each tetrahedron. This structure has been produced on the surface of Si by an ultrasonic cutting technique. Neither this technique nor its companion laser cutting are economically feasible at this time, though in the future the cost might become competitive. To economically produce this geometry, an anisotropic etch is applied to the proper crystalline orientation of silicon. The formation of inverted tetrahedrons has been demonstrated when anisotropic etches are applied to polycrystalline silicon with grains oriented in the (111) direction. A photolithographic step is required to obtain a regular repeating pattern on the surface before the wafer is immersed in the anisotropic etch. A mask pattern to produce the three perpendicular planes on (111) silicon is discussed in an article, titled "A New Texturing Geometry for Producing High Efficiency Solar Cells with no Antireflection Coatings", by A. W. Smith and A. Rohatgi, published in Solar Energy Materials and Solar Cells, Volume 29, at pages 51–65, 1993. This article is incorporated herein by reference. The peaks of the three perpendicular planes are directly under the thickest area of the mask pattern and some under cutting of the oxide may be required.

The inverted pyramid geometry of FIG. 3*c* may be formed in a manner similar to that of the inverted tetrahedron geometry by using a rectangular mask having a geometry to form four planes that are oriented at 53.75° with respect to the base of the structure.

The inventor simulated electron motion and backscattering of the electrons from the pit geometry of FIG. 3*b* and the inverted pyramid geometry of FIG. 3*c*. The planar surface geometry of FIG. 3*a* (silicon with an overcoat of aluminum and silicon with an overcoat of gold), as well as a planar surface of silicon without any overcoat (termed herein as bare silicon or planar silicon), were also examined to provide references for the pit geometry and the inverted pyramid geometry. The simulation and results of the simulation are discussed below.

The first texturing geometry selected to test the hypothesis of backscatter electron reduction and halo effect reduction is the inverted pyramid structure. This structure was chosen because it is easily created in silicon with one lithography step and an anisotropic etch. The second geometry selected was an etched pit structure in an optical block of fiber optic bundles, after that proposed by Suzuki et al. in U.S. Pat. No. 6,005,239 for image intensifiers (described in the background section of the specification). The second geometry has an advantage over the inverted pyramid structure, because the pit depth to pitch aspect ratio in the pit structure may be changed.

To simulate electron motion and scattering of electrons, two computer models were combined together. The first is a Monte Carlo model for high energy electron simulation, as taught by Joy in Monte Carlo Modeling for Electron Microscopy and Microanalysis, Oxford University Press Inc., NY, N.Y., 1995, which is incorporated herein by reference. This model provides the scattering and energy loss mechanism of the electrons, when the electrons are in the material. The direction cosines of a scattering electron is assumed to be the direction the electron is traveling, when the electron exits the material. To aid in the analysis, the energy of the electron is monitored. If the energy falls below 50 electron-volts (eV), the electron is assumed to be absorbed. If the electron is backscattered, however, then its path is traced by a second model, until the electron re-strikes a surface and enters the anode material again.

The second model deals with electrons which are outside the anode material and, therefore, does not include scattering events. During this phase of the simulation, the electrons behave as rays, provided that the anode texturing does not affect the field significantly. Techniques used to evaluate light trapping in solar cells, as disclosed by A. W. Smith and A. Rohatgi, in an article titled "Ray Tracing Analysis of the Inverted Pyramid Texturing Geometry for High Efficiency Silicon Solar Cells," in Solar Energy Materials and Solar Cells, Vol. 29, pp 37–49, 1993, were applied to simulating electron trapping with some modifications. This article is incorporated herein by reference.

Modifications in the second model from techniques used in silicon cells, however, were quite fundamental. First, the primary electrons have only a longitudinal component. This assumption is valid if the field between the cathode and anode is much larger than the transverse velocity component of the electron, when the electron exits the cathode. Second, the electron is not reflected like light, and the electron's angle of reflection is not equal to the electron's angle of incidence. Rather, the direction cosines of the backscattered electrons are given by Monte Carlo rules, as the electrons leave the anode material. Third, the field within the textured structure of the anode is ignored. This is valid provided that features of the textured geometry of the anode are much smaller than the cathode to anode spacing. These assumptions allow the electron to be treated as a ray, until the electron reaches the top of the textured structure.

The number of faces an electron encounters in its path was also recorded (see Table 1 below). So long as the electron remains in the textured structure, it may strike as many surfaces as possible depending on the scattering. If the electron reaches the top of the structure, however, the electron is treated as being in free flight, i.e. a cannonball. At the end of the free flight, the impact energy and position of the electron were recorded. Up to five free flights were recorded to determine the effect of multiple impacts.

To fairly compare the different structures, shown in FIGS. 3*a*–3*c*, however, the backscatter coefficient alone is not enough. The number of impact ionization events, or the number of secondary electrons generated was also cataloged in the simulation. Therefore, the gain at the incident point and halo points using several different incident energy electrons were compared for textured geometries, planar with aluminum geometry, and planar with gold covering geometry. Additional data collected was the energy of the electron at the point of impact after the first backscatter. The number of surfaces within the textured geometry that the electron strikes before it is backscattered was also recorded. Finally, the impact points of the backscattered electrons were recorded to provide an image pattern.

In the planar geometry and the inverted pyramid geometry impact ionization occurs in any of the silicon regions. In the pit geometry, the knock on process is only accounted for in the underlying silicon, not in the walls of the pit. The rationale for excluding the walls is that the generated carriers have a low probability of diffusing to the base material, the more likely outcome being that they may recombine at the wall surface. While gain is ignored in the walls, the energy loss of the primary electrons were accounted for in the simulation. Secondary electrons created by the primary electrons from the surfaces, however, were ignored due to several factors. The secondary electrons have low energy and, therefore, do not travel far in transverse directions, due to a high field between the cathode and anode. This low energy also means that the secondary electrons are incapable of producing gain. Finally, the surface features also inhibit secondary electron movement.

During the simulation, 10 million electron traces were started in a six micron square, centered at the origin, representing the texturing geometry. The spacing between the cathode and the planar surface of the anode was kept constant at 0.01 cm. This spacing controls the maximum distance the first, or any subsequent, backscattered electron may travel transversely, before re-hitting the anode surface.

The pit geometry of the anode was varied, as described below. Generally, however, the pit geometry was a six micron square with varying depths. In the pit geometry, the pitch size was 6 micron square with an open area ratio (OAR) of 84%. The OAR may range from 90% or higher if the anode is structurally sound, and down to 70% or lower if gain and signal to noise are not as important as structure. The etch pit depth was varied from 1.5 to 30 microns. The inverted pyramid geometry, on the other hand, was a 6 micron square with a depth of 4.091 microns.

To ensure that any halo reduction is not due to a decrease in the spacing between the cathode and anode, simulations were also performed at a pit pitch of 1 micron (μm) for selected energies and heights, as described below. It will be appreciated that pit pitch is defined as a distance from the center of a pit square to the center of the next pit square. During the simulation, the electron energy was also varied from 1 keV to 20 keV to evaluate the effect of the starting electron energy. For comparison the same energy conditions were also simulated for the planar geometries. The simulation was run in three-dimensional space.

Figure 4:
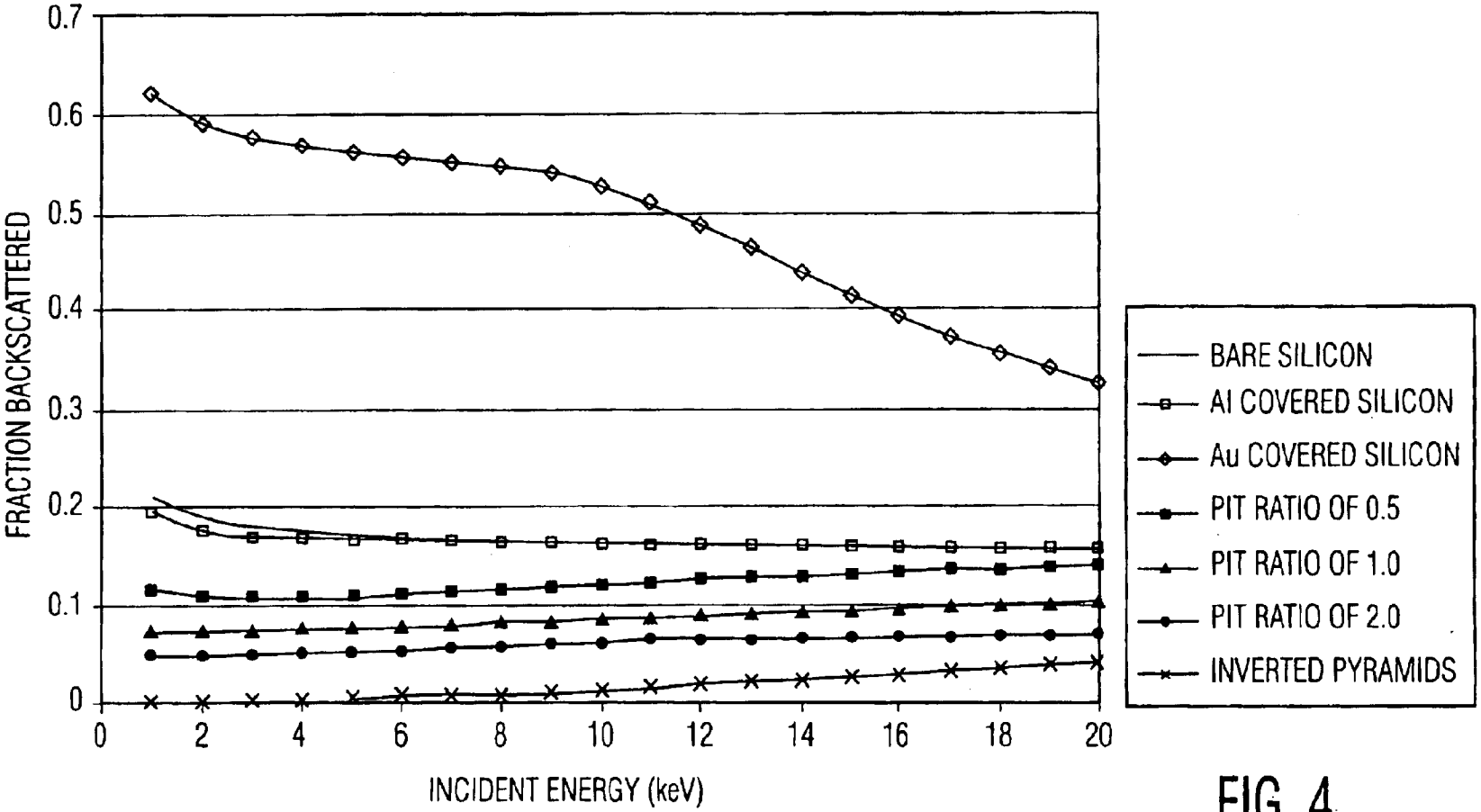
FIG. 4 is a graph of the fraction of backscattered electrons versus incident energy, showing results of a simulation using the textured surfaces shown in FIGS. 3*a*–3*c*, in accordance with an embodiment of the present invention.

Results of the simulation will now be discussed. Referring to FIG. 4, there is shown the fraction of backscattered electrons as a function of incident energy for seven different structures depicted in FIGS. 3*a*–3*c* (FIG. 3*a* depicts planar silicon structure 82 covered with layer 81 of aluminum or gold; and planar silicon 82 without layer 81, which is referred to in FIG. 4 as bare silicon. FIG. 3*b* depicts the pit geometry in which the pit ratio (depth to pitch ratio) includes 0.5, 1.0 and 2.0. FIG. 3*c* depicts the inverted pyramid). Accordingly, the seven structures include bare silicon, Al-covered silicon, Au-covered silicon, silicon layer having a pit ratio of 0.5, silicon layer having a pit ratio of 1.0, silicon layer having a pit ratio of 2.0, and silicon layer having inverted pyramids.

As shown in FIG. 4, at low incident energy levels for the three planar geometries, the backscatter coefficients are indicative of the top material layer of the anode. In the case of the Al-covered silicon, the backscatter coefficient quickly equilibrates to that of the underlying silicon layer. For the Au-covered silicon, however, the backscatter coefficient experiences an initial drop and then flattens out. As the incident energy continues to increase, the electrons penetrate through the gold, experience the silicon, and result in a drop of the backscatter coefficient.

Further examining FIG. 4, it may also be appreciated that the textured geometries are slightly less effective in reducing the backscatter coefficient, as the incident energy is increased. At higher incident energy, the electron is more likely to be scattered out of the textured geometries of the anode.

The textured geometries (the 3-pit ratios and the inverted pyramid of FIG. 4) possess lower backscatter coefficients compared to the planar structures, with the inverted pyramid having the lowest backscatter. It will be appreciated, however, that the resulting backscatter coefficients are much less than expected from experience with light trapping geometry which considers light as rays of light. In the case of rays of light, for instance, if the reflection coefficient is 20% then a double bounce reflection would be 4%, a triple bounce would be 0.8%. The observed backscatter coefficient, instead, is an order of magnitude lower (0.03% for the inverted pyramid) than light trapping geometry, because the electron does not behave like a ray of light. Once the electron enters the material, knowledge of the electron's previous trajectory history is lost due to the scattering. It is this loss of trajectory history which provides lowering of the reflection coefficient.

This may also be observed in Table 1, which shows the number of faces struck by an electron, before being absorbed or backscattered. Ten million electron traces were started in the simulation in the six micron square, discussed above.

Two different geometries are shown in the table, namely the inverted pyramid structure and the pit structure with a pit ratio of 1. Two different incident energies are also included for each geometry.

TABLE 1

Number of faces struck by an electron in different surface geometries and different incident energies.

| | 5 keV | | 15 keV | |
|---|---|---|---|---|
| Number of Faces Struck | Inverted pyramid | Pit Ratio = 1 | Inverted pyramid | Pit Ratio = 1 |
| 1 | 6907859 | 8577490 | 6997113 | 7659824 |
| 2 | 2351387 | 1053421 | 2258504 | 1167258 |
| 3 | 509673 | 282491 | 484361 | 706220 |
| 4 | 164780 | 67949 | 171405 | 315435 |
| 5 | 49116 | 15024 | 59234 | 109643 |
| 6 | 13082 | 2982 | 20138 | 31314 |
| 7 | 3253 | 534 | 5622 | 7924 |
| 8 | 682 | 96 | 1654 | 1885 |
| 9 | 145 | 10 | 559 | 387 |
| 10 | 23 | 3 | 210 | 110 |

Still referring to Table 1, it may be observed that a fraction of the electrons are backscattered, after striking only one plane. This result is impossible for light rays, in these texturing geometries, at normal incidence. It may also be observed in the table that a very small fraction of incident electrons hit 5 or more planes, before being backscattered out of the textured surfaces. This result also is not possible for light rays in these geometries.

Figure 5:
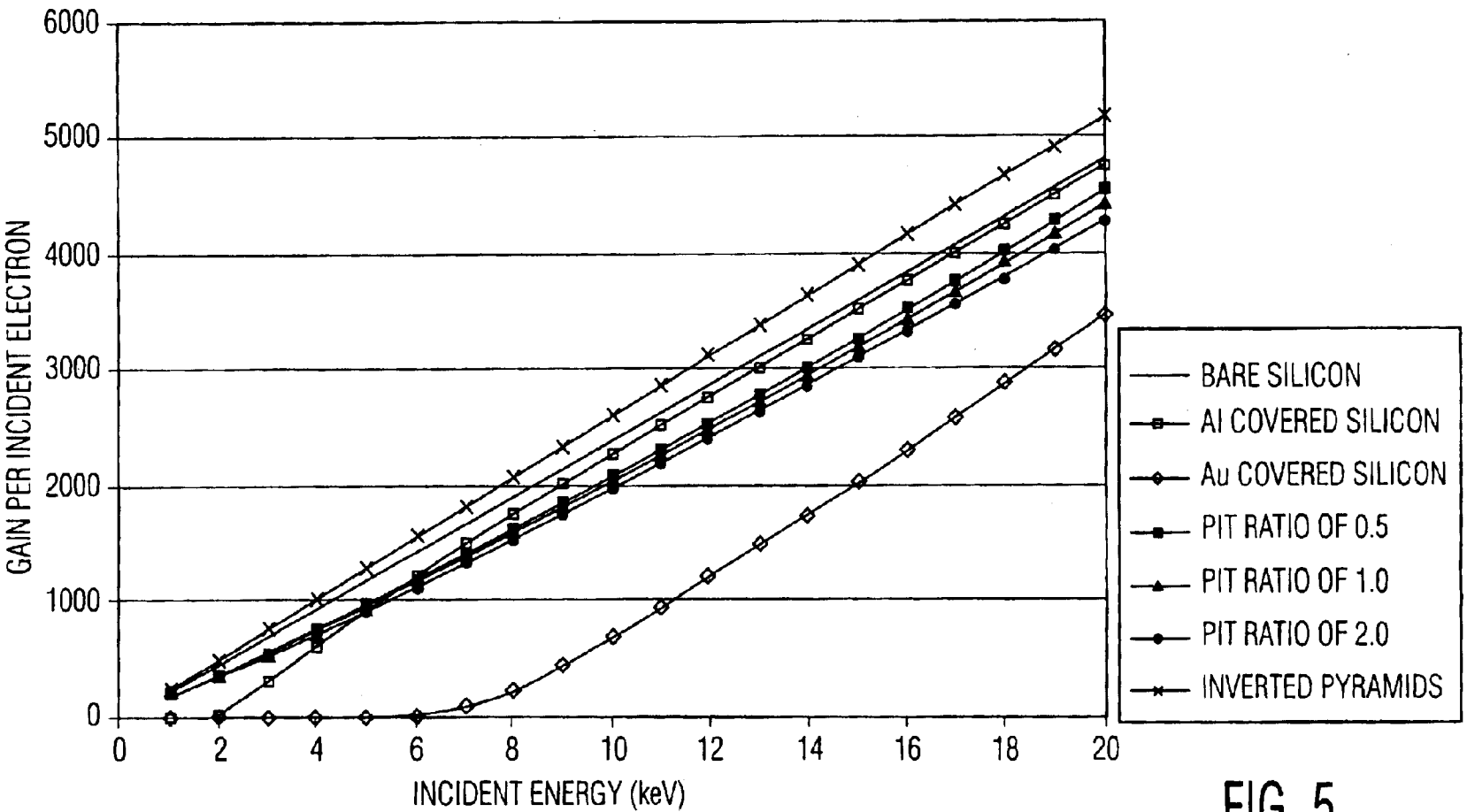
FIG. 5 is a graph of the gain per incident electron versus incident energy, showing results of a simulation using the textured surfaces shown in FIGS. 3*a*–3*c*, in accordance with an embodiment of the present invention.

Referring next to FIG. 5, there is illustrated the gain per incident electron at its incident point. For the cases of aluminum and gold covered silicon, there is a dead voltage which must be overcome before gain may be achieved. The gain for the aluminum covered silicon quickly approaches the bare silicon case. In case of the pits, there is a nearly a constant offset in the gain equal to the OAR. This tends to separate, however, as the pits get deeper and the energy increases. The inverted pyramid structure, however, always demonstrates the highest gain at the electron incident point as a function of all of the incident energies.

Figure 6A:
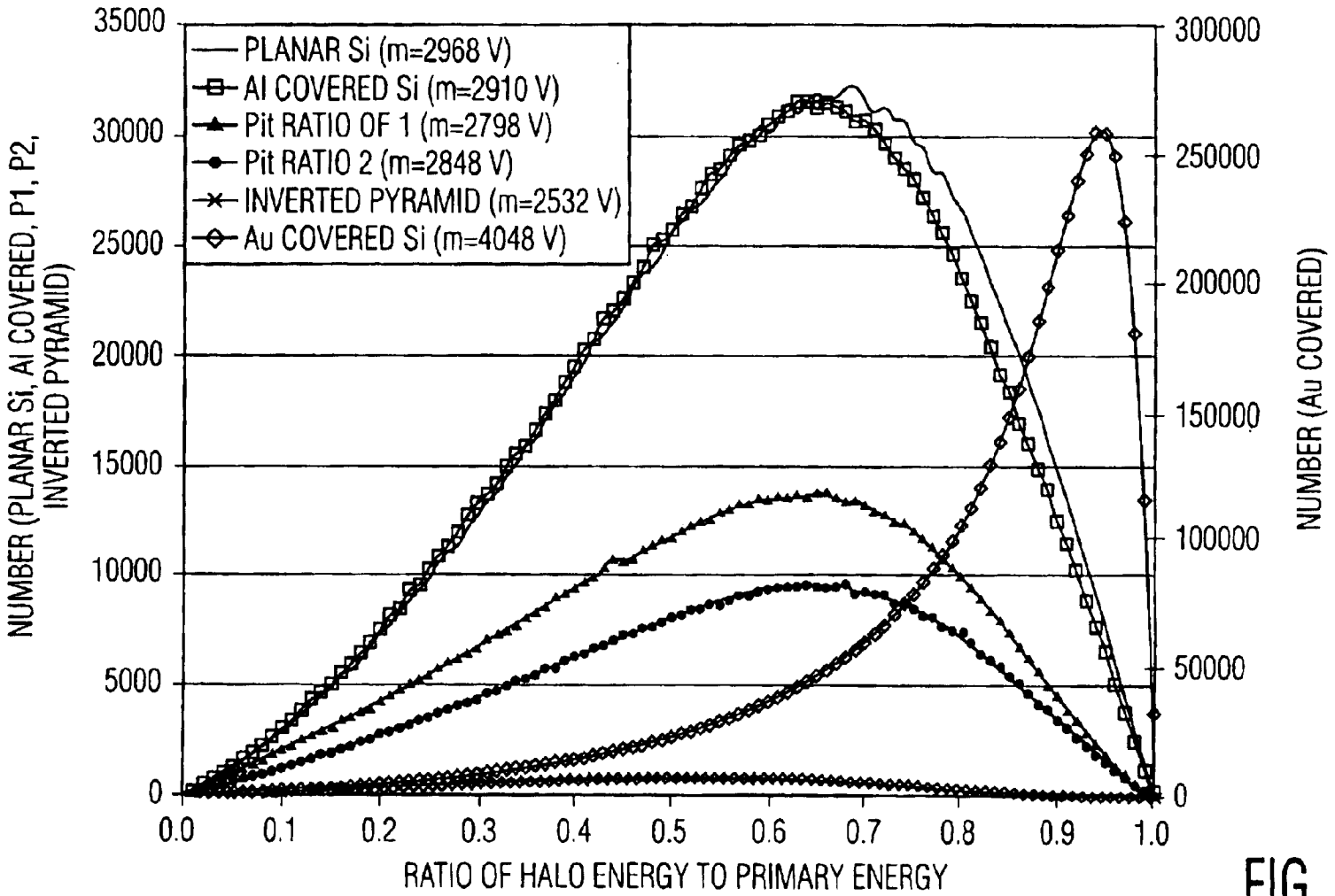
FIGS. 6*a*–6*b* is a graph of the distribution of energy versus ratio of halo energy to primary energy, showing results of a simulation using the textured surfaces shown in FIGS. 3*a*–3*c*, in accordance with an embodiment of the present invention.
Figure 6B:
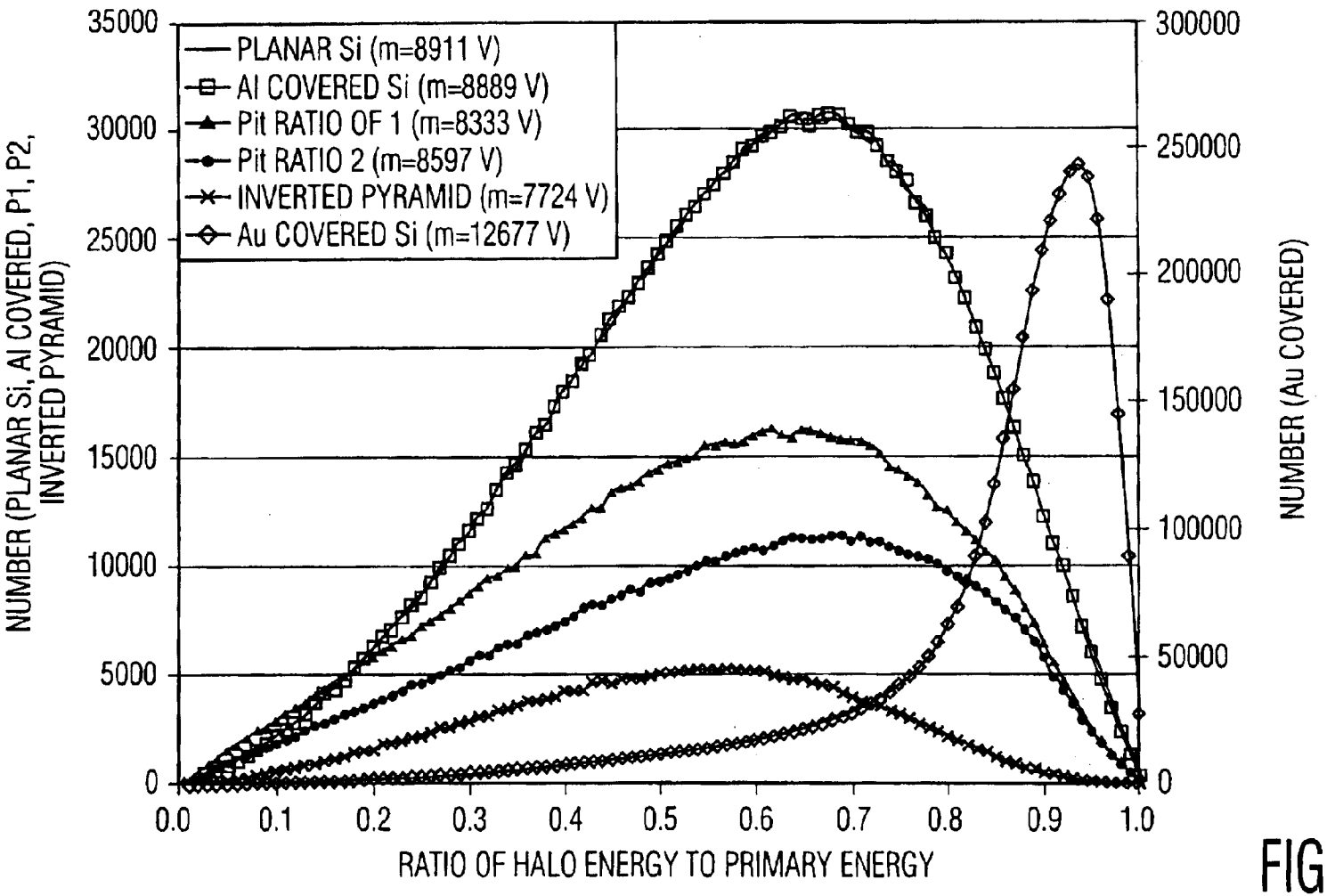

Referring next to FIGS. 6*a* and 6*b*, there is shown the electron energy distribution at the first backscatter impact point, normalized to the primary electron energy for 6 different geometries (pit ratio of 0.5 is not shown). FIG. 6*a* depicts results for incident energy at 5 keV and FIG. 6*b* depicts the results for incident energy at 15 keV.

Listed in parenthesis, in the legends of FIGS. 6*a* and 6*b*, are the mean values of the backscatter energy for each of the geometries. The backscatter impact energy distributions for the textured geometries (pits and inverted pyramids) are lower than the planar surface geometries. The trends shown in FIGS. 6*a* and 6*b*, along with the lower backscatter result shown in FIG. 4 and the primary electron gain shown in FIG. 5, reveals several things. First, because more electrons are created in the local area of the textured surface by impact ionization prior to the primary electron leaving the area, and less energy is contained in the backscatter event, less electrons are created by impact ionization at the impact site. Second, because the backscatter coefficient is lower, fewer electrons contribute to the halo, thereby making the halo less intense. Finally, because of the lower backscattered electron energy, the anode potential causes the electron to be pulled back down to the anode, thereby diminishing the distance the backscattered electron travels. In addition, because the walls of the pits or inverted pyramids cut down on the escape angles, further reduction of the radial distance of the bright spot may be achieved, as shown below.

Figure 7:
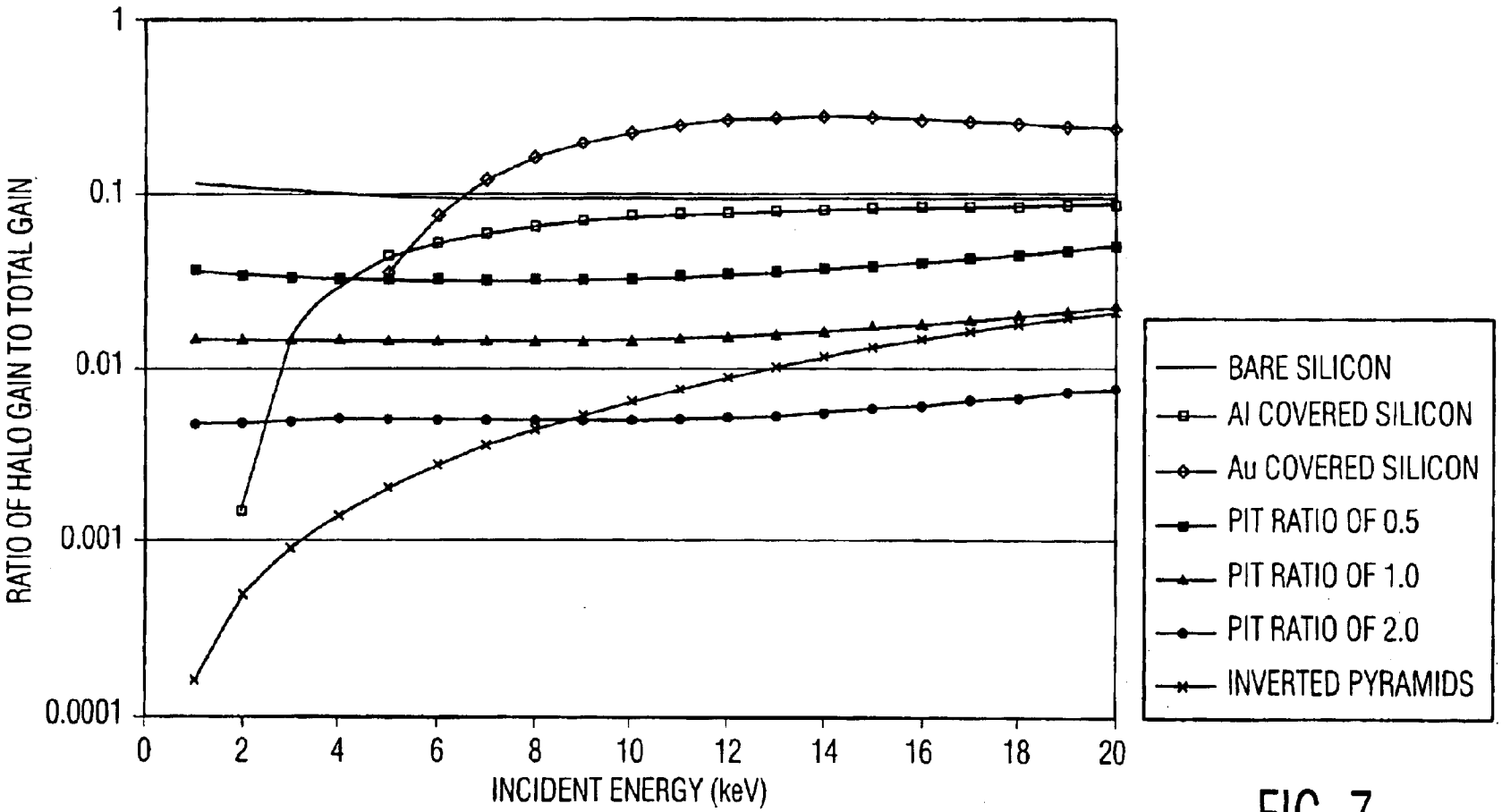
FIG. 7 is a graph of the ratio of halo gain to total gain versus incident energy, showing results of a simulation using the textured surfaces shown in FIGS. 3*a*–3*c*, in accordance with an embodiment of the present invention.

Referring next to FIG. 7, there is shown the ratio of halo gain to total gain as a function of the incident energy for seven different structures. As shown, the halo is smaller and not as bright for the textured geometries, as compared to the halo in the planar silicon geometries. It will be appreciated that the aluminum and gold covered silicon also have lower halo gain initially, though, it will be recalled, that the primary electron gain is also low due to the dead voltage. The three pit geometries shown in FIG. 7 each has a decreasing halo gain, as the pit depth is increased (pit ratios of 0.5, 1.0 and 2.0). These pit geometries also stay relatively constant in their ratio of halo gain to total gain as the incident energy is increased. The inverted pyramid geometry, on the other hand, has very low halo intensity at low energy, but increases in halo intensity as the incident energy increases. The best trend shown in FIG. 7 is likely the pit geometry with a depth to pitch ratio of 2.0.

Referring next to FIGS. 8*a*–8*f*, there are shown spatial trends for the halo patterns of six different structures using 5 keV incident energy. The spatial outputs are shown in these figures for the first quadrant only. The spatial outputs in the other three quadrants may be constructed by symmetry, because they are the same as that shown in the first quadrant.

As shown in the plots, the intensities are normalized to the aluminum covered structure and have been digitized to a 12 bit gray scale for display. The inserts, at the top right, of each of FIGS. 8*a*–8*f* display the radial trend of each halo. The plot for the planar (bare) silicon shows a nearly saturated central region with an intensity that tails off. For the gold covered structure, the plot of FIG. 8*b* shows a random circular pattern. Although the pattern is not fully developed, the points are very intense. As shown, all of the planar geometries have halos reaching a radial distance of two times the cathode to anode spacing. The halos outside the initial radius is due to the multiple impacts of the electrons, or due to secondary halos.

The overcoated planar samples (FIGS. 8*b*–8*c*) show high intensities near the extreme radius, because only the highest energy backscattered electron reaches this distance. For the case of the two pit geometries (FIGS. 8*d*–8*e*), the intensity is less than the overcoated aluminum sample, and slightly smaller in size.

In addition, the intensity decreases as a function of radius, as the depth to pitch ratio is increased. It will also be appreciated that the radial intensity inserts for the pit geometries are different from the radial intensity inserts of the planar geometries and show a continually decreasing trend. The case of the inverted pyramid (FIG. 8*f*), however, has a much smaller radius and a lower intensity than any of the other five geometries.

Recalling the previous discussion on loss of trajectory history in the electrons, the results shown in FIGS. 8*d*–8*f* for the textured surfaces also support the conclusion that the trajectory history of the electrons is lost in these textured surfaces. In all cases there does not appear to be any angular dependence in the scattering of the electrons. On the other hand, due to the geometry and the direction of the incident electrons, a distinct pattern should have evolved, if the electrons retained their trajectory history in the texture. Because the diagonals of the pit and pyramid structures are longer than their pitch dimensions, the halo patterns should have led to a deviation from a circular pattern. Since the patterns shown in FIGS. 8*d*–8*f* retain their circular pattern, it supports a conclusion that there is no trajectory history in the movement direction of the backscattered electrons.

FIGS. 9*a*–9*f* show results of the spatial patterns for the same structure geometries as those shown in FIGS. 8*a*–8*f*, except now the incident particle energy is 15 keV. The planar (bare) silicon, aluminum-covered silicon, and the two pit geometries (FIGS. 9*a, c, d* and *e*) show substantially the same shape and intensity profiles as those shown in corresponding FIGS. 8*a, c, d*, and *e*. For the gold-covered planar geometry of FIG. 9*b*, however, the pattern is now fully developed. The pattern shows a high intensity for first impacts, at radii less than 0.02 cm, and shows secondary impacts at outer radii greater than 0.02 cm. This shows that the heavy atomic mass unit (AMU) gold metal is trapping the electrons under the material in the silicon. Unfortunately, the resulting intensity is high, making gold-covered silicon unusable for imaging applications.

In the case of the inverted pyramid geometry of FIG. 9*f*, as compared to the inverted pyramid geometry of FIG. 8*f*, the intensity and radius are increased and approach the intensity and radius of the pit with a depth to pitch ratio of 1.0.

Figure 10:
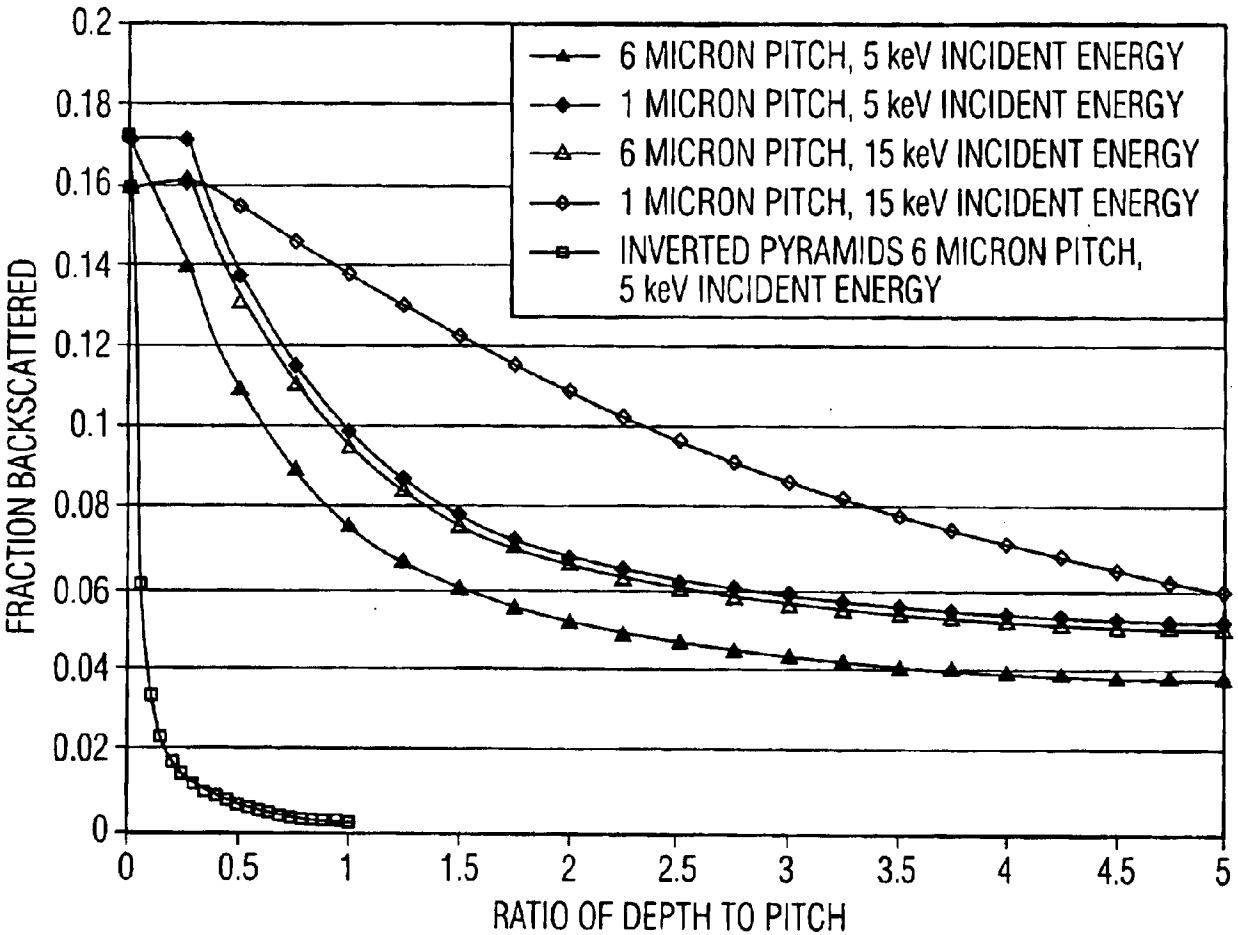
FIG. 10 is a graph of the fraction of backscattered electrons versus ratio of depth to pitch, showing results of a simulation using the textured surfaces shown in FIGS. 3*a*–3*c*, in accordance with an embodiment of the present invention.

FIG. 10 illustrates the fraction backscattered of electrons as a function of depth to pitch ratio for the pit structure at two different pitches (6 micron pitch and 1 micron pitch) and at two different incident energies of 5 keV and 15 keV. FIG. 10 also illustrates fraction backscattered as a function of depth to pitch ratio for the inverted pyramid geometry at 6 micron pitch and 5 keV of incident energy.

FIG. 10 illustrates that as the depth to pitch ratio increases, the fraction backscattered decreases and appears to asymptote to a value of 0.05 for the pit geometries, regardless of the pitch value. In addition, the fraction backscattered decreases to a value of 0.002 for the inverted pyramid geometry.

Figure 11:
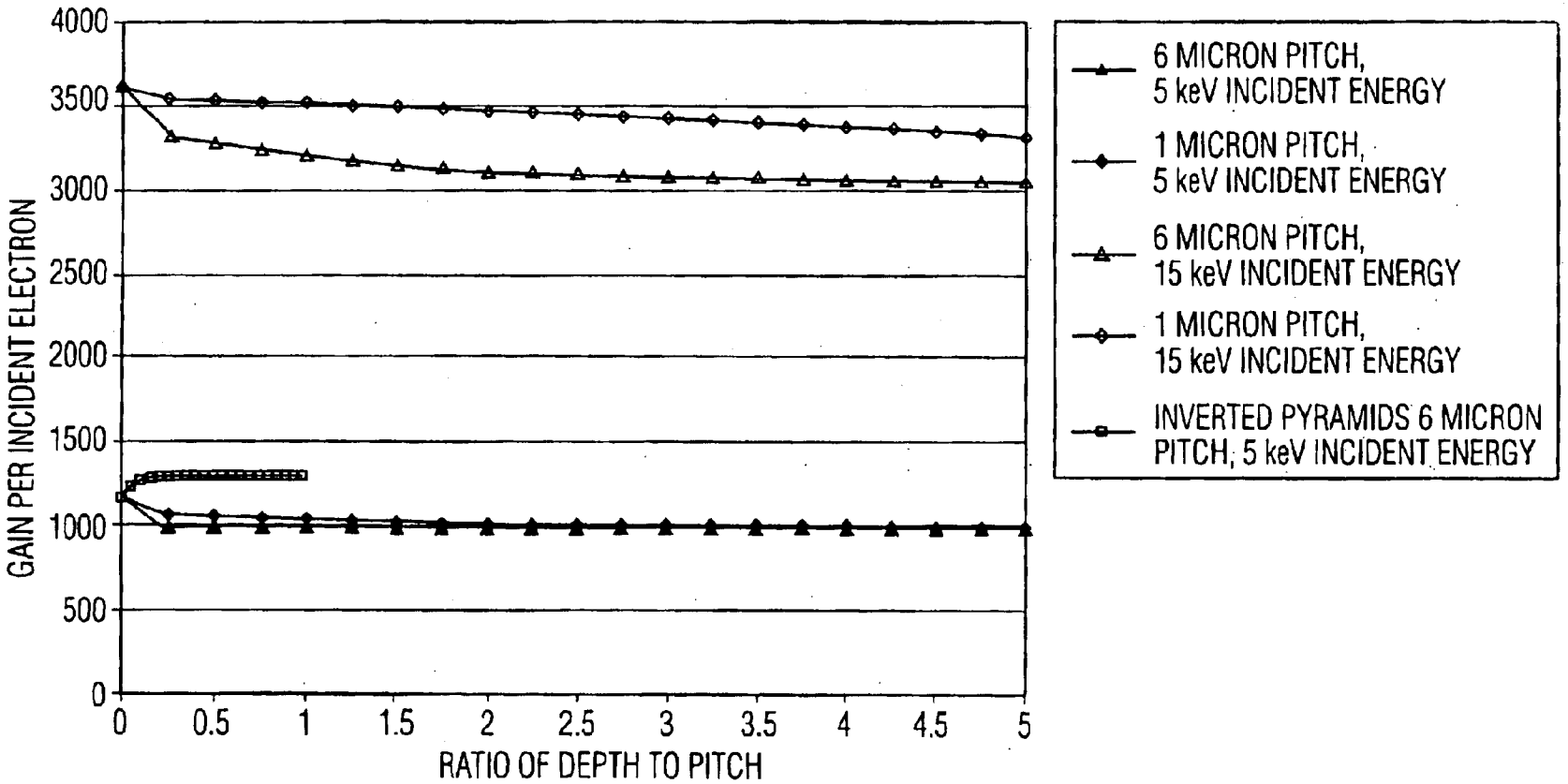
FIG. 11 is a graph of the gain per incident electron versus ratio of depth to pitch, showing results of a simulation using the textured surfaces shown in FIGS. 3*a*–3*c*, in accordance with an embodiment of the present invention.

FIG. 11 illustrates the gain per incident electron as a function of depth to pitch ratio for the pit structure at two different pitches (6 micron pitch and 1 micron pitch) and at two different incident energies of 5 keV and 15 keV. FIG. 11 also illustrates gain per incident electron as a function of depth to pitch ratio for the inverted pyramid geometry at 6 micron pitch and 5 keV of incident energy.

FIG. 11 demonstrates that the gain per incident electron is constant for the low incident energies, regardless of the pitch. At higher incident energy, however, a difference is observed depending upon the pitch, although the trend is the same as the depth to pitch ratio changes.

Figure 12:
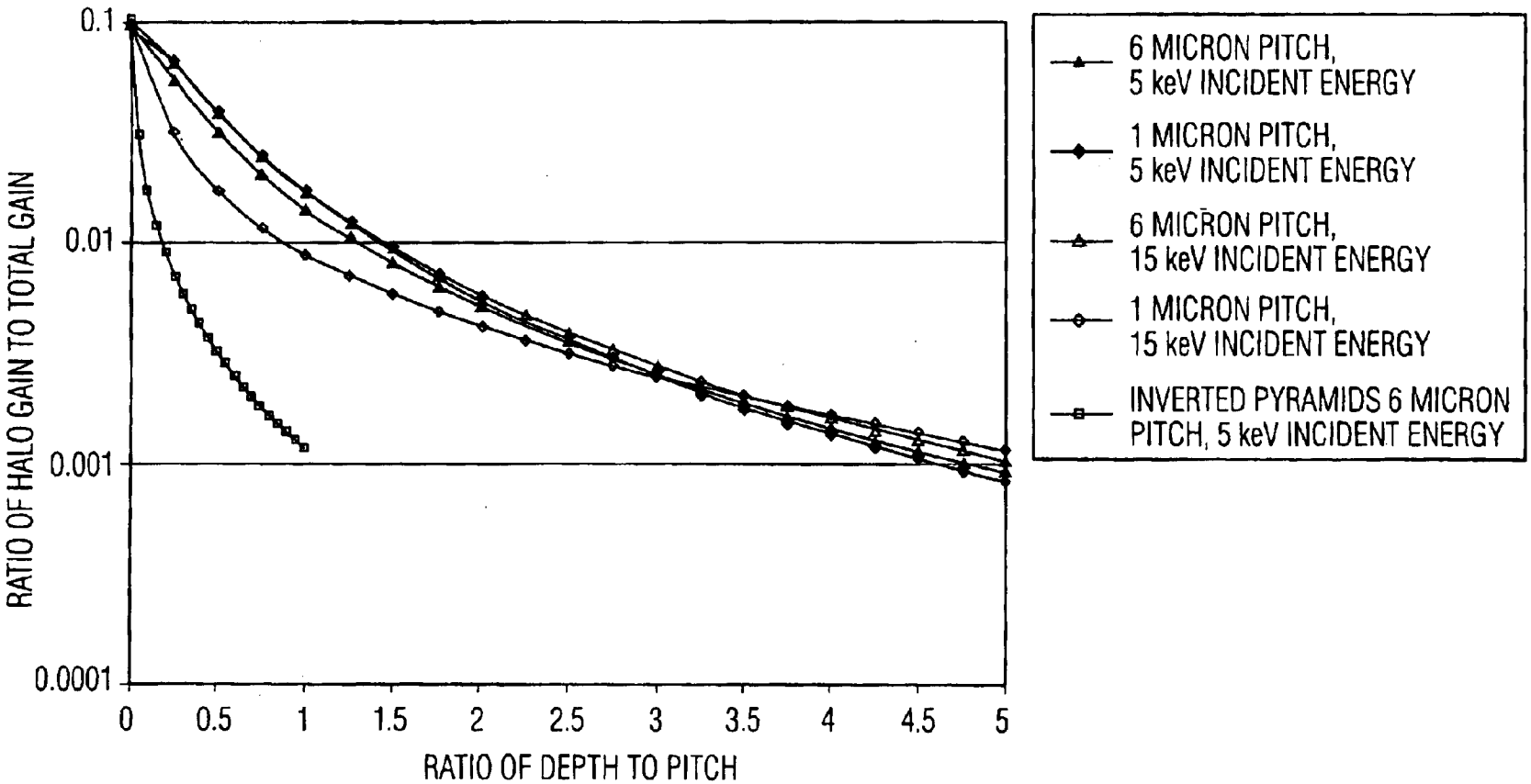
FIG. 12 is a graph of the ratio of halo gain to total gain versus ratio of depth to pitch, showing results of a simulation using the textured surfaces shown in FIGS. 3*a*–3*c*, in accordance with an embodiment of the present invention.

FIG. 12 illustrates the ratio of halo gain to total gain as a function of depth to pitch ratio for the pit geometry at two different pitches (6 micron pitch and 1 micron pitch) and at two different incident energies of 5 keV and 15 keV. FIG. 12 also illustrates ratio of halo gain to total gain as a function of depth to pitch ratio for the inverted pyramid geometry at 6 micron pitch and 5 keV of incident energy.

FIG. 12 demonstrates that the ratio of halo gain to total gain decreases for all geometries considered. Of course, a decrease in the ratio of halo gain to total gain is desirable. To ensure that the pitch does not contribute to a reduction in the size of the halo, the inventor considered pits with 1 micron pitch in the simulation. FIGS. 13*a*–13*b* are plotted for pits having a 1 micron pitch, and may be compared to FIGS. 8*d* and 8*e* for pits having a 6 micron pitch. This comparison demonstrates that the same halo size occurs for the same depth to pitch ratio, regardless of the pitch value. Thus, pitch value does not contribute to a reduction in the size of the halo Texturing geometry of anodes, as shown in FIG. 3*b* and 3*c* may be used to diminish the intensity and radius of halos in electron bombarded devices. The history of the particle trajectory is lost due to scattering in the material and this offers some advantage in reducing the backscatter coefficient. The magnitude of the improvement is dependent on the incident energy and the depth to pitch ratio of the texturing geometry. The simulations also show that the texturing geometries reduce the halo radius, and the reduction in size is dependent on the depth to pitch ratio of the geometry.

It was also demonstrated that the use of a high AMU material does trap the electrons in the silicon. However, due to the higher backscatter coefficient of the top gold material, a bright halo with the characteristic halo radius is produced. Very little difference is seen between the planar uncoated silicon and the overcoated aluminum silicon. None of the planar geometries offer a reduction of the halo radius.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An electron sensing device comprising a cathode for providing a source of electrons, and an anode disposed opposite to the cathode for receiving electrons emitted from the cathode, wherein the anode includes a textured surface for reducing halo in the output signal of the electron sensing device.

2. The electron sensing device of claim 1 wherein the textured surface includes a plurality of pits formed in the anode.

3. The electron sensing device of claim 2 wherein a pit of the plurality of pits is shaped as a well having a top opening formed by longitudinal walls in the anode, and a bottom surface of the well is disposed longitudinally further from the cathode than the top opening.

4. The electron sensing device of claim 3 wherein the top opening of the well is substantially a square opening and the bottom surface of the well is dimensionally substantially similar to the square opening.

5. The electron sensing device of claim 2 wherein the plurality of pits are transversely spaced from each other by a pitch value varying from 1.0 micron to 30.0 microns, and include longitudinal depths varying from a depth to pitch ratio of 0.5 to a depth to pitch ratio of 2.0.

6. The electron sensing device of claim 5 wherein the plurality of pits are spaced from each other to form an open area ratio (OAR) ranging between 70% and 90% in the anode.

7. The electron sensing device of claim 5 wherein the anode and cathode include a potential difference to provide an initial energy value to the emitted electron, the energy value varying between 1 keV and 20 keV.

8. The electron sensing device of claim 2 wherein the electron sensing device is one of a hybrid photodiode (HPD), an electron bombarded active pixel sensor (EBAPS), an electron bombarded charge coupled diode (EBCCD), an electron bombarded metal-semiconductor-metal vacuum phototube (MSMVPT), an s avalanche photo diode (APD) and a resistive anode.

9. The electron sensing device of claim 2 wherein a microchannel plate (MCP) is disposed between the cathode and anode.

10. The electron sensing device of claim 2 wherein the anode is formed of semiconductor material and is free-of an anti-reflection coating (ARC).

11. The electron sensing device of claim 2 wherein the longitudinal distance between the cathode and anode is larger than a pitch value of the plurality of pits transversely spaced from each other.

12. An electron sensing device comprising a cathode for providing a source of electrons, and an anode disposed opposite to the cathode for receiving electrons emitted from the cathode, wherein the anode includes a top surface, and the top surface includes a plurality of openings, each defined by a base of an inverted pyramid, for reducing halo in the output signal of the electron sensing device.

13. The electron sensing device of claim 12 wherein the base of the inverted pyramid is substantially a square at the top surface of the anode, and walls formed in the anode are extended from the base to form an apex of the inverted pyramid, the apex disposed longitudinally further from the cathode than the base of the inverted pyramid.

14. The electron sensing device of claim 13 wherein the base of the inverted pyramid is a 6 micron square, and the apex of the inverted pyramid is longitudinally disposed 4.091 microns from the base.

15. The electron sensing device of claim 12 wherein the plurality of openings are transversely spaced from each other by a pitch of 6.0 microns and forms an OAR ranging between 70% and 90%.

16. The electron sensing device of claim 12 wherein the anode and cathode include a potential difference to provide an initial energy value to the emitted electron, the energy value varying between 1 keV and 20 keV.

17. The electron sensing device of claim 12 wherein the electron sensing device is one of a hybrid photodiode (HPD), an electron bombarded active pixel sensor (EBAPS), an electron bombarded charge coupled diode (EBCCD), an electron bombarded metal-semiconductor-metal vacuum phototube (MSMVPT), an avalanche photo diode (APD) and a resistive anode.

18. The electron sensing device of claim 12 wherein a microchannel plate (MCP) is disposed between the cathode and anode.

19. The electron sensing device of claim 12 wherein the anode is formed of semiconductor material and is free-of an anti-reflection coating (ARC).

20. An electron sensing device comprising a cathode for providing a source of electrons, and an anode disposed opposite to the cathode for receiving electrons emitted from the cathode, wherein the anode includes a textured surface for reducing halo in the output signal of the electron sensing device, and the textured surface includes one of a plurality of pits and a plurality of inverted pyramids.

* * * * *